US009926927B2

(12) United States Patent
Curodeau et al.

(10) Patent No.: US 9,926,927 B2
(45) Date of Patent: Mar. 27, 2018

(54) BELT AND SUPPORT FOR A ROTOR MECHANISM IN A ROTARY APPARATUS AND ROTARY APPARATUS COMPRISING SAME

(71) Applicant: Gullivert Technologies Inc., Québec (CA)

(72) Inventors: Marc-Alexandre Curodeau, Québec (CA); Benoit Allen, Québec (CA); Rémi Hudon, Saint-Jean-Port-Joli (CA); Jimmy Laflamme Laroche, St-Nicolas (CA)

(73) Assignee: Gullivert Technologies Inc., Quebec (CA)

( * ) Notice: Subject to any disclaimer, the term of this patent is extended or adjusted under 35 U.S.C. 154(b) by 656 days.

(21) Appl. No.: 14/351,772

(22) PCT Filed: Oct. 12, 2012

(86) PCT No.: PCT/CA2012/050718

§ 371 (c)(1),
(2) Date: Apr. 14, 2014

(87) PCT Pub. No.: WO2013/053062

PCT Pub. Date: Apr. 18, 2013

(65) Prior Publication Data

US 2014/0248173 A1 Sep. 4, 2014
US 2015/0071808 A2 Mar. 12, 2015

Related U.S. Application Data

(60) Provisional application No. 61/547,453, filed on Oct. 14, 2011.

(51) Int. Cl.
*F04C 2/40* (2006.01)
*F04C 5/00* (2006.01)
(Continued)

(52) U.S. Cl.
CPC ..... *F04C 2/40* (2013.01); *F01C 1/40* (2013.01); *F01C 21/08* (2013.01); *F04C 5/00* (2013.01); *F04D 29/406* (2013.01)

(58) Field of Classification Search
CPC ..... F01C 1/40; F04C 2/40; F04C 5/00
See application file for complete search history.

(56) References Cited

U.S. PATENT DOCUMENTS 3,196,854 A 7/1965 Novak
3,369,529 A 2/1968 Jordan
(Continued)

FOREIGN PATENT DOCUMENTS

AT 179971 10/1954
CA 2192714 6/1998
(Continued)

OTHER PUBLICATIONS www.dictionary.com, definition of pivot, Apr. 23, 2017.*

*Primary Examiner* — Mary A Davis
(74) *Attorney, Agent, or Firm* — Price Heneveld LLP

(57) ABSTRACT

A pump comprises a housing having an inner contour wall defining a fluid chamber. A rotor mechanism is positioned within the fluid chamber and comprises a belt and a rotatable rotor assembly. The belt is mounted to the rotor assembly. A movement imparting assembly imparts a rotational movement to the rotor assembly. The belt engages the inner contour wall during rotation. The housing includes intake and outtake ports in communication with the fluid chamber providing for intake of fluid therein and exhaust of fluid therefrom.

22 Claims, 19 Drawing Sheets

(51) Int. Cl.

| | |
|---|---|
| ***F01C 1/40*** | (2006.01) |
| ***F01C 21/08*** | (2006.01) |
| ***F04D 29/40*** | (2006.01) |

(56) References Cited

U.S. PATENT DOCUMENTS

| | | | |
|---|---|---|---|
| 3,442,257 | A | 5/1969 | Walker |
| 3,614,277 | A | 10/1971 | Kobayashi |
| 3,677,668 | A | 7/1972 | Rosenberg |
| 4,144,866 | A | 3/1979 | Hakner |
| 4,385,874 | A | 5/1983 | Savoie, Jr. |
| 4,434,757 | A | 3/1984 | Walker |
| 6,164,263 | A | 12/2000 | Saint-Hilaire et al. |
| 6,431,840 | B1 | 8/2002 | Mashimo et al. |
| 6,659,065 | B1 | 12/2003 | Renegar |
| 6,691,648 | B2 | 2/2004 | Beierle |
| 6,718,938 | B2 | 4/2004 | Szorenyi |
| 6,722,321 | B2 | 4/2004 | Kim |
| 6,899,075 | B2 | 5/2005 | Saint-Hilaire et al. |
| 7,055,327 | B1 | 6/2006 | Pekrul et al. |
| 7,178,502 | B2 | 2/2007 | Okulov |
| 7,343,894 | B2 | 3/2008 | Leon |
| 2002/0189578 | A1 | 12/2002 | Szorenyi |
| 2003/0062020 | A1 | 4/2003 | Okulov |
| 2004/0079321 | A1 | 4/2004 | Saint-Hilaire et al. |
| 2012/0269618 | A1 | 10/2012 | Curodeau |

FOREIGN PATENT DOCUMENTS

| | | |
|---|---|---|
| CA | 2732810 | 2/2010 |
| JP | 1211678 | 8/1989 |
| WO | 8600370 | 1/1986 |
| WO | 9735096 | 9/1997 |
| WO | 0190536 | 11/2001 |
| WO | 2004070169 | 8/2004 |
| WO | 2010017199 | 2/2010 |
| WO | 2010055223 | 5/2010 |

* cited by examiner

BELT AND SUPPORT FOR A ROTOR MECHANISM IN A ROTARY APPARATUS AND ROTARY APPARATUS COMPRISING SAME

CROSS-REFERENCE TO RELATED APPLICATIONS

This application claims priority under 35USC§ 119(e) of U.S. provisional patent application 61/547,453 filed on Oct. 14, 2011, the specification of which is hereby incorporated by reference. This application is a national phase entry of PCT patent application serial number PCT/CA2012/050718, filed on Oct. 12, 2012, designating the United States of America.

TECHNICAL FIELD

The technical field relates to a rotary apparatus. More specifically, but not exclusively, it relates to a pistonless rotary pump, compressor or engine. More particularly, but still not exclusively, the technical field relates to a belt and support for a rotor mechanism in a rotary apparatus.

BACKGROUND

The Quasiturbine or Qurbine engine is a pistonless rotary engine or pump using a substantially rhomboidal rotor which sides are hinged at the vertices. The volume enclosed between the sides of the rotor and the rotor housing provides compression and expansion in a fashion similar to Wankel engine, but the hinging at the edges allows the volume ratio to increase. The Quasiturbine is proposed as a Stirling engine, a pneumatic engine using stored compressed air, and as a steam engine.

Drawbacks with the Quasiturbine include the high amount of friction between the hinged vertices and sides of the rhomboidal rotor and the inner wall of the housing as well as the inner sides of the lateral covers, which results in energy loss as well as damage. Furthermore, the friction between the rhomboidal rotor of the Quasiturbine and the inner wall of the housing does not allow using this apparatus in the turbine mode with a gaseous fluid since the gas will escape between the pressurized compartments within the pump. As such, the Quasiturbine requires a starter.

SUMMARY

It is therefore an aim of the present invention to address at least partially some of the above mentioned issues.

In accordance with a general aspect, there is provided a pump comprising: a housing having an inner contour and defining a chamber; a rotor mechanism positioned within the chamber and being configured to rotate and comprising a belt for engaging the inner contour, the belt being mounted to a rotor assembly; a movement imparting assembly for imparting a rotational movement to the rotor assembly; and intake and outtake ports in communication with the chamber providing for intake of fluid therein and exhaust of fluid therefrom.

According to a general aspect, there is provided a pump comprising: a housing having an inner contour wall defining a fluid chamber; a rotor mechanism positioned within the fluid chamber and comprising a rotatable rotor assembly and a belt mounted to the rotor assembly for engaging the inner contour wall; a movement imparting assembly for imparting a rotational movement to the rotor assembly; and intake and outtake ports defined in the housing in communication with the fluid chamber providing for intake of fluid therein and exhaust of fluid therefrom, the intake and outtake ports being sealed by the belt in at least one configuration of the rotor assembly.

In an embodiment, the rotor assembly has a peripheral outer shape which varies during rotation thereof and the belt has a peripheral closed-loop shape which conforms to the peripheral outer shape of the rotor assembly.

In an embodiment, a peripheral closed-loop shape of the belt changes during rotation of the rotor assembly.

In an embodiment, wherein the belt comprises a closed-loop strap and an articulated closed-loop structure underlying the closed-loop strap.

In an embodiment, the articulated closed-loop structure comprises a flexible annular bearing assembly mounted to a periphery of the rotor assembly and having an outer surface juxtaposed inwardly to an inner surface of the closed-loop strap.

In an embodiment, the rotor assembly comprises an articulated rigid structure underlying the belt. A peripheral outer shape of the articulated rigid structure can be modified during rotation of the rotor assembly.

In an embodiment, the fluid chamber is ovaloidal shaped and the rotor assembly is rhomboidal shaped.

In an embodiment, the intake and outtake ports are sealed simultaneously by the belt.

In an embodiment, the intake ports and the outtake ports are configured in an alternating configuration.

In an embodiment, the intake and outtake ports are sealed by the belt in at least four configurations of the rotor assembly per rotation thereof.

In an embodiment, the belt abuts the inner contour wall at at least four contact points. Positions of the contact points on the inner contour wall can rotate simultaneously with the rotor assembly. A respective one of the intake and the outtake ports can be sealed when a corresponding one of the contact points is aligned therewith.

In an embodiment, the rotor assembly comprises a plurality of rollers mounted inwardly of the belt. The rollers can be operatively connected to the movement imparting assembly.

In an embodiment, the rotor assembly comprises a plurality of pivotally connected blades.

According to a general aspect, there is provided a rotary apparatus comprising: a housing having an inner wall defining a fluid chamber and having at least one intake port and at least one outtake port in fluid communication with the fluid chamber respectively providing for intake of fluid therein and exhaust of fluid therefrom; and a rotor mechanism mounted within the fluid chamber and comprising a rotatable rotor assembly and a belt mounted peripherally to the rotor assembly and engaging sections of the inner wall during rotation of the rotor assembly.

In an embodiment, the belt comprises a closed-loop strap and an articulated closed-loop rigid structure underlying the closed-loop strap. The articulated rigid structure can comprise a flexible annular bearing assembly mounted to a periphery of the rotor assembly and can have an outer surface juxtaposed inwardly to an inner surface of the closed-loop strap.

In an embodiment, the rotor assembly has a peripheral outer shape which varies during rotation thereof and the belt has a peripheral closed-loop shape which conforms to the peripheral outer shape of the rotor assembly.

In an embodiment, a peripheral shape of the belt changes during rotation of the rotor assembly.

In an embodiment, the rotor assembly comprises an articulated rigid structure supporting the belt.

In an embodiment, the rotor assembly comprises a plurality of rollers mounted inwardly of the belt. The rollers can be operatively connected to a movement imparting assembly.

In an embodiment, the fluid chamber is ovaloidal shaped and the rotor assembly is rhomboidal shaped.

In an embodiment, the rotary apparatus comprises two intake ports and two outtake ports defined in the housing and in fluid communication with the fluid chamber, the intake and outtake ports being sealed by the belt in at least one configuration of the rotor assembly. The intake and outtake ports can be sealed by the belt in at least four configurations of the rotor assembly per rotation thereof.

In an embodiment, the rotary apparatus comprises a plurality of fluid intake ports and a plurality of fluid outtake ports and the fluid intake ports and the fluid outtake ports are configured in an alternating configuration.

In an embodiment, the at least one intake port and the at least one outtake port are sealed simultaneously by the belt.

In an embodiment, the belt abuts the inner wall at at least four contact points. Positions of the contact points on the inner wall can rotate simultaneously with the rotor assembly. A respective one of the at least one intake port and the at least one outtake port can be sealed when a corresponding one of the contact points is aligned therewith.

In an embodiment, the rotary apparatus comprises a movement imparting assembly for imparting a rotational movement to the rotor assembly.

According to a further general aspect, there is provided a rotary apparatus comprising: a housing having an inner contour wall defining an ovaloidal fluid chamber therein and at least one fluid intake port and at least one fluid outtake port in fluid communication with the fluid chamber; and a rotor mechanism mounted inside the fluid chamber and comprising a rotatable rotor assembly and a belt mounted to the rotor assembly and being in contact with the inner contour wall at a plurality of contact points, the belt sealing the at least one fluid intake port and the at least one fluid outtake port when the contact points are aligned therewith.

In an embodiment, the belt comprises a closed-loop strap and an articulated closed-loop rigid structure underlying the closed-loop strap.

In an embodiment, the articulated closed-loop rigid structure comprises a flexible annular bearing assembly mounted to a periphery of the rotor assembly and having an outer surface juxtaposed inwardly to an inner surface of the closed-loop strap.

In an embodiment, the rotor assembly has a peripheral outer shape which varies during rotation thereof and the belt has a peripheral closed-loop shape which conforms to the peripheral outer shape of the rotor assembly.

In an embodiment, a peripheral shape of the belt changes during rotation of the rotor assembly.

In an embodiment, the rotor assembly comprises an articulated rigid structure supporting the belt and is rhomboidal shaped.

In an embodiment, the rotor assembly comprises a plurality of rollers mounted inwardly of the belt. The rollers can be operatively connected to a movement imparting assembly.

In an embodiment, the rotary apparatus comprises a movement imparting assembly for imparting a rotational movement to the rotor assembly.

In an embodiment, the rotary apparatus comprises two intake ports and two outtake ports defined in the housing and in fluid communication with the fluid chamber, the intake and outtake ports being sealed by the belt in at least one configuration of the rotor assembly.

In an embodiment, the intake and outtake ports are sealed by the belt in at least four configurations of the rotor assembly per rotation thereof.

In an embodiment, the rotary apparatus comprises a plurality of fluid intake ports and a plurality of fluid outtake ports and the fluid intake ports and the fluid outtake ports are configured in an alternating configuration.

In an embodiment, the at least one intake port and the at least one outtake port are sealed simultaneously by the belt.

In an embodiment, the belt abuts the inner contour wall at at least four contact points.

In an embodiment, positions of the contact points on the inner contour wall rotate simultaneously with the rotor assembly.

In an embodiment, the belt comprises a polymeric closed-loop strap with a continuous outer surface.

In an embodiment, the rotary apparatus is a pump.

Other objects, advantages and features of the disclosure will become more apparent upon reading of the following non-restrictive description of non-limiting illustrative embodiments thereof, given by way of example only with reference to the accompanying drawings.

BRIEF DESCRIPTION OF THE DRAWINGS

In the appended drawings, like reference numerals denote like elements throughout and in where:

FIG. 7 includes FIGS. 7*a*, 7*b*, and 7*c* and shows side elevational views of the rotary apparatus in accordance with another embodiment, wherein a housing includes a crown of fins to promote heat exchange.

It will be noted that throughout the appended drawings, like features are identified by like reference numerals.

DETAILED DESCRIPTION

Generally stated, there is provided a rotary apparatus that comprises a housing having an inner contour wall that defines an internal fluid chamber. A rotor mechanism is positioned within the chamber and is configured to rotate therein. The rotor mechanism comprises a belt and a rotatable rotor assembly. The belt is a closed-loop belt and is mounted to the rotor assembly. The rotor assembly is a rotatable rigid structure which supports and modifies a peripheral shape of the belt. A movement imparting assembly imparts a rotational movement to the rotor assembly. The belt engages sections of the inner contour wall during rotation of the rotor assembly. The housing further includes intake and outtake ports in fluid communication with the internal fluid chamber providing for intake of fluid therein and exhaust of fluid therefrom. The rotary apparatus disclosed herein can be a pump, a compressor or an engine, which can be used in a variety of fields.

With reference to the appended drawings, non-restrictive illustrative embodiments will be described so as to provide examples and not limit the scope of the disclosure.

Figure 2:
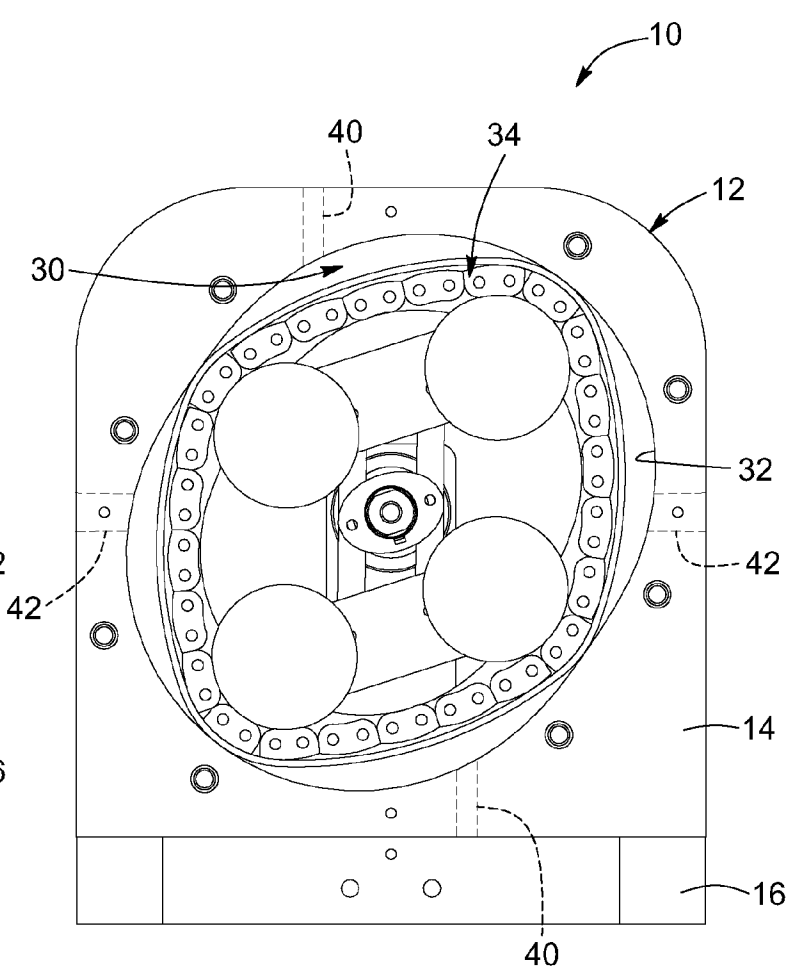
FIG. 2 is a front elevation view of the rotary apparatus shown in FIG. 2, wherein fluid intake ports and fluid outtake ports are unobstructed by the rotor mechanism and the apparatus is shown without lateral plates.
Figure 1:
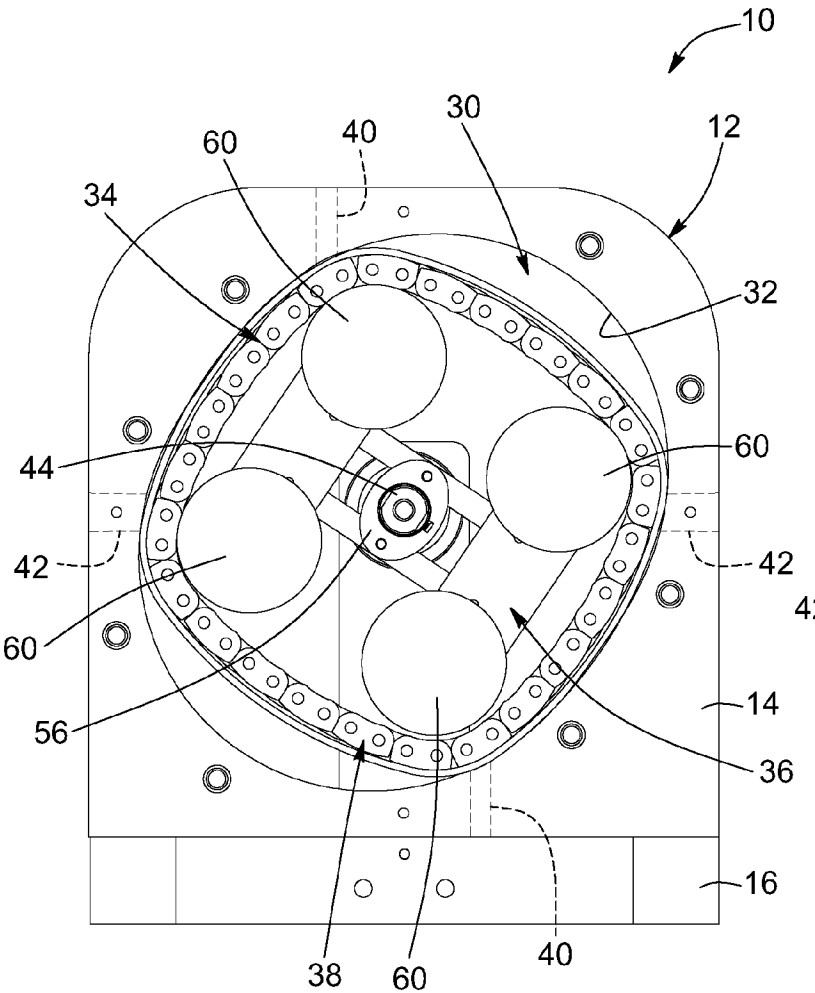
FIG. 1 is a front elevation view of a rotary apparatus in accordance with an embodiment, wherein a rotor mechanism is configured to obstruct fluid outtake ports and fluid intake ports and the apparatus is shown without lateral plates.
Figure 3:
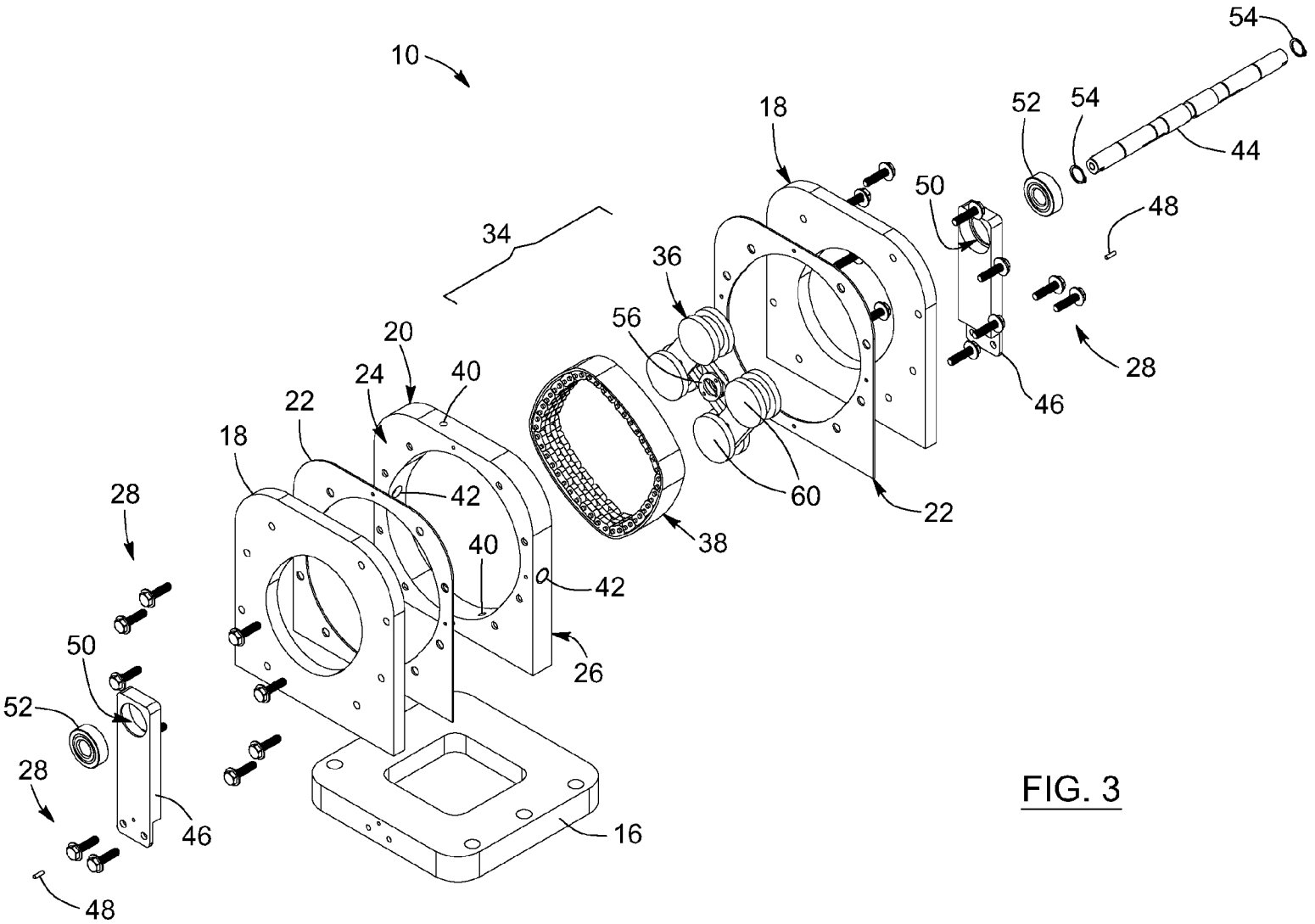
FIG. 3 is an exploded perspective view of the rotary apparatus shown in FIGS. 1 and 2.

FIGS. 1 to 3 show a rotary apparatus 10, such as a pump, comprising a main body 12 including a stator housing (or casing) 14. The stator housing 14 includes a base 16 on which are mounted lateral plates 18 sandwiching therebetween a profile plate 20. Leak proof sheets 22 are positioned between each side 24 and 26 of the profile plate 20 and each lateral plate 18. The foregoing pieces are assembled together via fasteners 28 (including screws and washers) to provide the stator housing 14.

The assembled housing 14 defines an ovaloidal fluid chamber 30 circumscribed by an inner contour wall 32 for housing a substantially rhomboidal rotor mechanism 34 including, amongst others, a rotor assembly 36 and a belt 38. The belt 28 defines a closed-loop and is mounted to the periphery of the rotor assembly 36 and conforms to its outer peripheral shape as will be described in more details below. Radial intake ports 40 and outtake ports 42 are formed through the stator housing 14 and, more particularly in the profile plate 20, and are in fluid communication with the fluid chamber 30. The fluid intake ports 40 and outtake ports 42 provide respectively for intake of fluid in the fluid chamber 30 and exhaust of fluid therefrom. The combination of the leak proof sheets 22, the lateral plates 18, the inner wall 32 of the housing 14, and the rotor mechanism 34 prevents fluid communication between the fluid chamber 30 and the atmosphere.

A shaft 44 traverses the stator housing 14 through its fluid chamber 30 and is operatively connected to the rotor assembly 36. Rotation of the shaft 44 engages the rotor assembly 36 in rotation. The shaft 44 is supported at opposite side thereof by shaft support plates 46 mounted on each lateral plate 18 via respective fasteners 28 and respective positioning dowels 48. Each shaft support plate 46 includes a respective aperture 50 for housing bearings 52 through which the shaft 44 is journalled at opposite ends thereof for axial rotation along its longitudinal axis. Retaining rings 54 are provided for retaining the shaft 44 in position. The shaft 44 is part of a movement imparting assembly of the apparatus 10.

Figure 4:
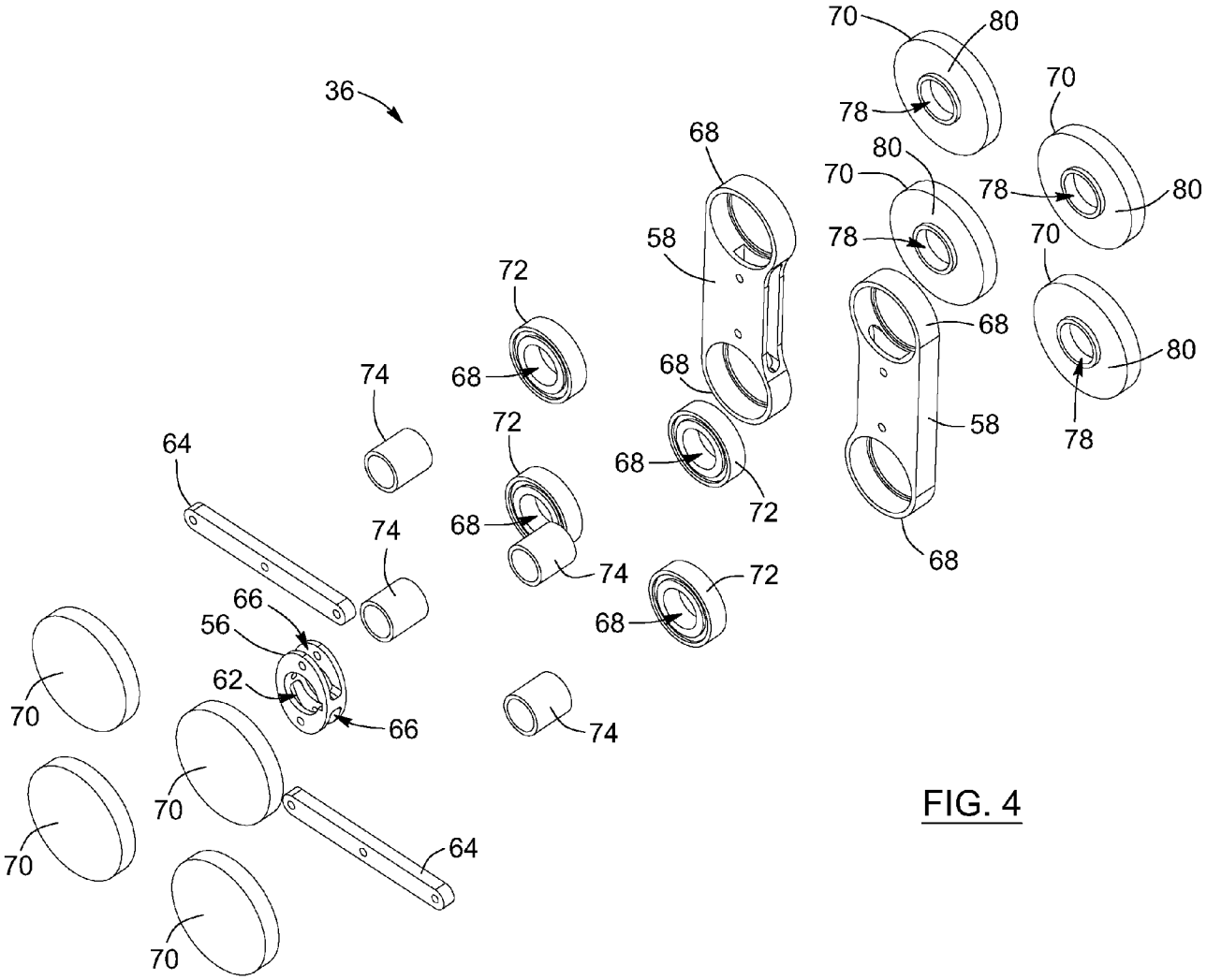
FIG. 4 is an exploded perspective view of a rotor assembly of the rotor mechanism shown in FIGS. 1 and 2.

Turning now to FIGS. 3 and 4, there is shown that the rotor assembly 36 comprises a centerpiece 56 connected to a pair of blades 58 and four rollers 60. The centerpiece 56 comprises a central aperture 62 for receiving the shaft 44 therethrough and being engaged therewith. The centerpiece 56 is connected to the blades 58 via a pair of connecting rods 64. Accordingly, the centerpiece 56 comprises two spaced-apart slots 66 for receiving and securing the connecting rods 64 therein.

Each blade 58 has two opposite longitudinal ends, with each of the ends forming a circular aperture 68. Each one of the circular apertures 68 is configured for mounting one of the rollers 60 to a respective one of the blades 58. More particularly, each roller 60 comprises a pair of discs 70 mounted at each opposite face of their respective blades 58, aligned with their respective circular aperture 68. Each circular aperture 68 houses a respective bearing 72 therein. A journal bearing 74 is fitted within the central aperture 76 of the bearing 72 and extends outwardly therefrom at each opposite face of their respective circular aperture 68. Each journal bearing 74 is fitted at each longitudinal end thereof into a circular cavity 78 defined in the inner face 80 of each disc 70. As such, when assembled, each roller 60 is rotatable relative to its respective circular aperture 68 about the longitudinal axis defined by the journal bearing 74.

Figure 5:
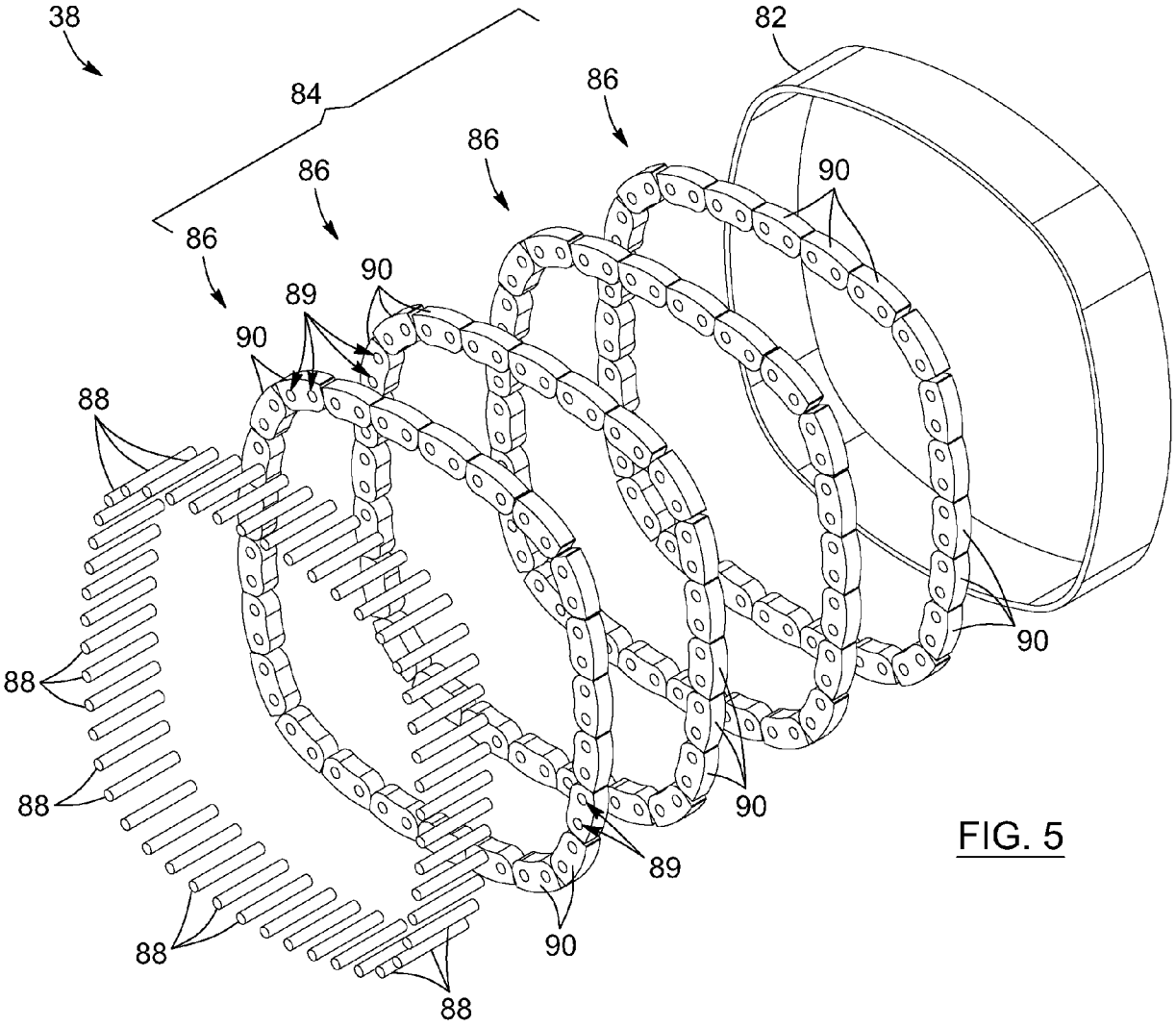
FIG. 5 is an exploded perspective view of a belt of the rotor mechanism shown in FIGS. 1 and 2.

Turning now to FIG. 5, a first embodiment of the belt 38 will be described. The belt 38 comprises an outer strap 82 strapped onto a chain assembly 84 comprising four chains 86 mounted in an adjacent configuration and secured together via dowels 88 inserted through the aligned holes 89 of the chain links 90 of each separate chain 86. It is appreciated that the belt 38 can include more or less chains 86. The outer strap 82 and the chain assembly 84 are closed-loop components.

Rotation of the shaft 44 modifies the peripheral shape of the chains 86. Consequently, the peripheral shape of the outer strap 82 is simultaneously modified. Thus, the contact points between the outer strap 82 and the inner contour wall 32 of the chamber 30 vary simultaneously with the rotation of the shaft 44.

Figure 6:
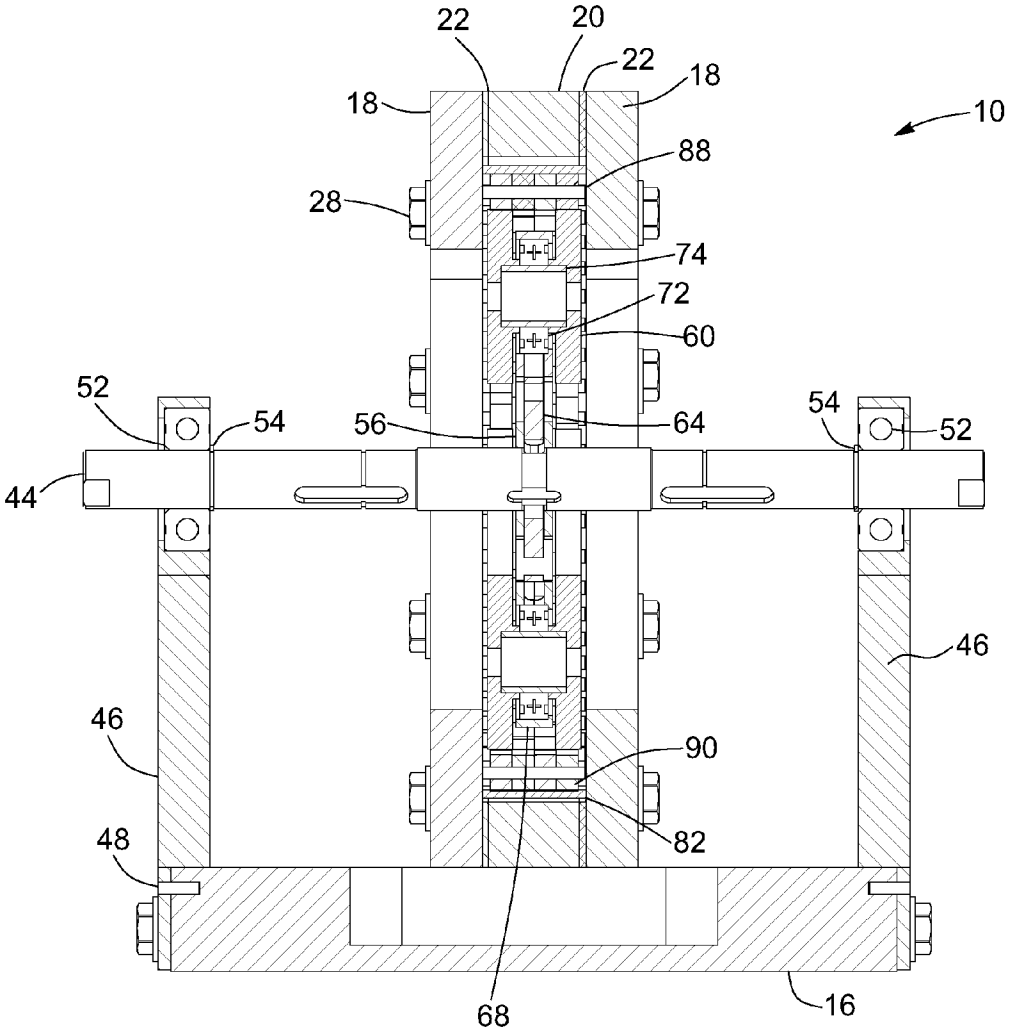
FIG. 6 is a lateral sectional view of the assembled rotary apparatus shown in FIGS. 1 and 2 and including the lateral plates.

FIG. 6 shows a sectional view of the rotary apparatus 10 when assembled.

In operation, the shaft 44 is actuated and rotates about its longitudinal axis thereby causing the rotor assembly 36 to rotate therewith since its centerpiece 56 is connected to the shaft 44. Rotation of the rotor assembly 36 engages in rotation the rollers 60. In turn, the rollers 60 rollingly engage the inner surface of the belt 38, namely the inner surface of the juxtaposed and assembled chains 86. The peripheral shape of the belt 38 including its contact points with the inner contour wall 32 is consequently modified.

The rotor assembly 36 is a rigid structure with a variable shape (depending on its configuration within the internal fluid chamber 30), which supports and defines the shape of the flexible closed-loop belt 38 mounted peripherally thereof. The belt 38 is flexible in a manner such that it conforms to the shape of the rotor assembly 36. The belt 38 is configured to abut sections of the inner contour wall 32 of the chamber 30. The sections abutted by the belt 38, i.e. the contact points, vary in accordance with the shape of the rotor assembly 36 to which the belt 38 is mounted.

The rotor assembly 36 thus rotates in the fluid chamber 30. During rotation, the volume of the rotor mechanism 34 varies. Consequently, the free volume of the fluid chamber 30, i.e. the volume of the chamber 30 unoccupied by the rotor mechanism 34, varies simultaneously. Furthermore, during rotation, the configuration of the rotor mechanism 34 within the fluid chamber 30 varies. FIG. 1 shows that the intake and outtake ports 40, 42 being sealed (or obstructed) by the rotor mechanism and FIG. 2 shows that all the ports 40, 42 are open (or unobstructed). In FIG. 1, the intake and outtake ports 40, 42 are covered by the rotor mechanism 34. More particularly, the outer strap 82 of the belt 38 covers the ports 40, 42 and prevents fluid exchange with the chamber 30.

As mentioned above, during rotation of the rotor mechanism 34, the volume between the periphery of the belt 38 and the inner contour wall 32 varies. An expansion of the volume causes suctioning, i.e. fluid intake in the chamber 30, through the fluid intake ports 40 and a compression of the volume causes propulsion, i.e. fluid outtake of the chamber 30, through the fluid outtake ports 42.

During rotation, the contact points of the belt 38 slides along the inner contour wall 32. Rotation of the rotor assembly 36 does not engage in rotation the belt 38. The rollers 60 abut on the inner surface of the assembled chains 86 and modify their shape. The contact points of the belt 38 vary with the rotation of the rotor assembly 36 due to the rotor assembly shape changes. It is possible that the belt 38 also slides slightly with respect to the contour wall 32. In one non-restrictive example, the strap 82 can be made of a smooth, resilient and deformable polymeric material. Of course, the skilled artisan can contemplate other suitable materials for the strap 82 that ensure substantial airtightness. The strap 82 can be made of a resilient material, such as a suitable composite polymer, in a manner such that the rotor assembly 36 and the chains 86 will apply pressure thereon and compress the strap 82 against the inner contour wall 32 to ensure a substantial fluid sealing.

Referring to FIG. 7, there is shown an alternative embodiment of the rotary apparatus 10*a*. The rotary apparatus 10*a* is similar to the rotary apparatus 10 described above in reference to FIGS. 1 to 5, except regarding the housing 14. For concision purposes, only the differences between the two embodiments will be discussed hereinbelow. More particularly, in the embodiment shown in FIG. 7, the housing 14*a* has a substantially ovaloidal cross-section and a profile plate 20*a* with a plurality of fins 92 protruding from an outer surface thereof. The crown of fins 92 promotes heat exchange between the housing and ambient air. It is appreciated that the shape of the housing, and the number and the shape of the fins can vary from the embodiments shown in the accompanying figures.

Figure 7C:
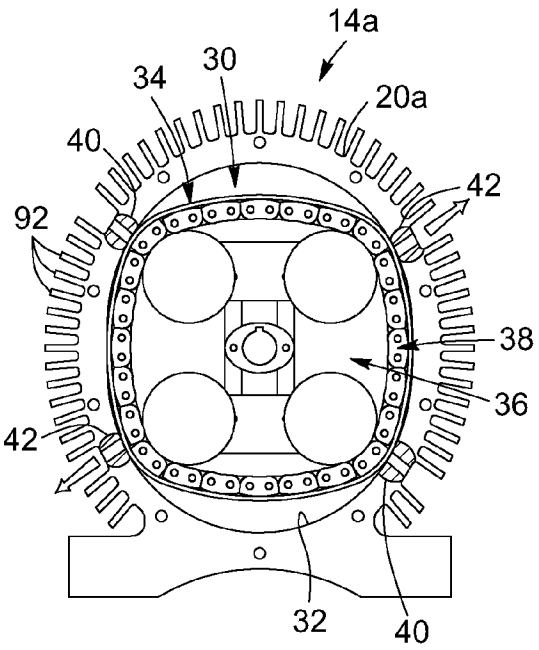
FIG. 7*c* shows the rotor mechanism configured in a fluid outlet phase.
Figure 7B:
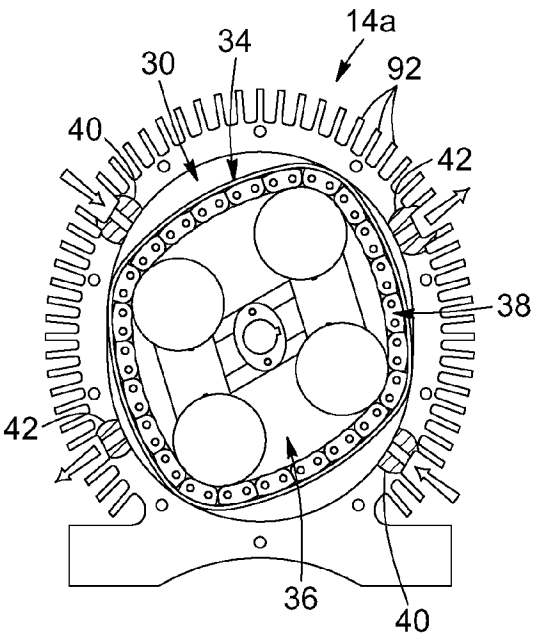
FIG. 7*b* shows the rotor mechanism configured in an intermediate configuration.
Figure 7A:
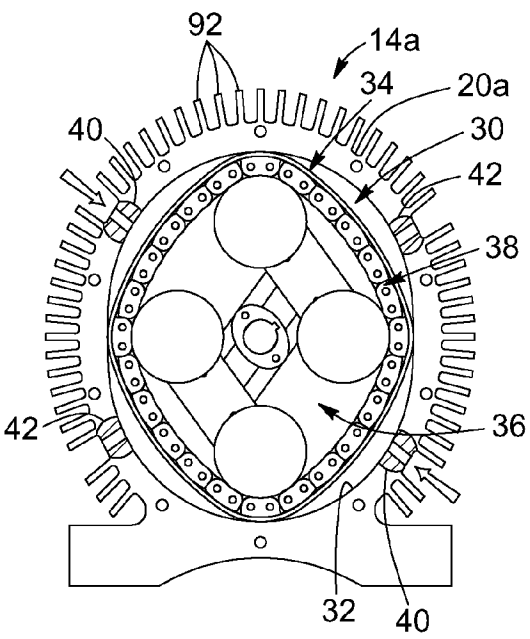
FIG. 7*a* shows a rotor mechanism configured in a fluid inlet phase.

FIG. 7 further shows a quarter of a rotation of the rotor mechanism 34 in the fluid chamber 30. In FIG. 7*a*, the intake and outtake ports 40, 42 are unobstructed by the rotor mechanism 34. The chamber 30 expands and fluid is suctioned through the fluid intake ports 40 in the chamber 30. FIG. 7*a* shows the beginning of a fluid compression cycle and the pressure within the chamber 30 is relatively low. In FIG. 7*b*, the intake and outtake ports 40, 42 are still unobstructed by the rotor mechanism 34. The sections of the chamber 30 in fluid communication with the fluid intake ports 40 continues their expansion and fluid is suctioned therein through the fluid intake ports 40. The sections of the chamber 30 in fluid communication with the fluid outtake ports 42 contract and fluid contained therein is compressed and propulsed outwardly of the chamber 30 through the fluid outtake ports 42. This is an intermediate state of the compression cycle, the pressure within the chamber 30 increases in comparison with the pressure of FIG. 7*a*. In FIG. 7*c*, the rotor mechanism 34 obstructs both the intake and outtake ports 40, 42. More particularly, the belt 38 covers the intake and outtake ports 40, 42. This is the end of the compression cycle.

Following FIG. 7*c*, another cycle begins wherein fluid is admitted within the housing through the fluid intake ports 40 as shown in FIG. 7*a*. For a complete rotation of the rotor mechanism 34 within the fluid chamber 30 (360°), eight compression cycles occur (one for each quarter of a rotation), each cycle beginning with admission of fluid within the fluid chamber 30 through the fluid intake ports 40 (FIG. 7*a*) and ends with the belt 38 covering the intake and outtake ports 40, 42 (FIG. 7*c*).

The fluid intake ports 40 can be in fluid communication with a fluid supply such as a gas or liquid supply. In a non-limitative embodiment, the gas supply is ambient air. The fluid outtake ports 42 can be in fluid communication with a compression chamber (not shown) wherein the compressed fluid is contained until a valve, mounted downstream of the compression chamber, is configured in an open configuration. In a non-limitative embodiment, a valve can be mounted in the fluid outtake ports 42.

For instance and without being limitative, the rotor assembly 36 and the housing 14 can be made of iron, such as galvanized steel, aluminum, such as anodized aluminum, and combination thereof. The inner contour wall 32 of the housing 14 can be lined with a polymer such as PTFE to reduce abrasion and avoid lubrication needs.

Figure 8:
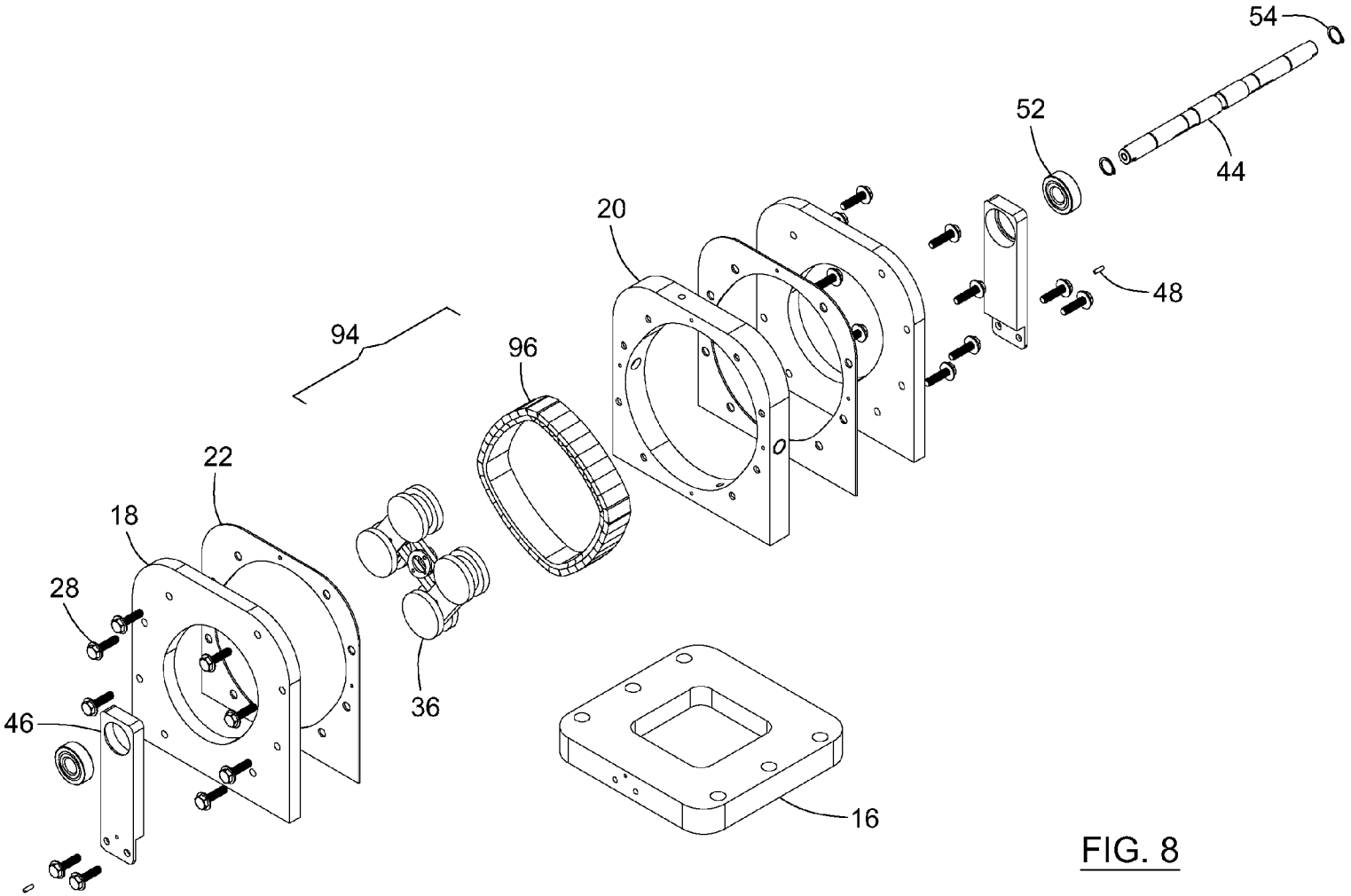
FIG. 8 is an exploded perspective view of a rotary apparatus in accordance with another embodiment, with another embodiment of a rotor mechanism.
Figure 9:
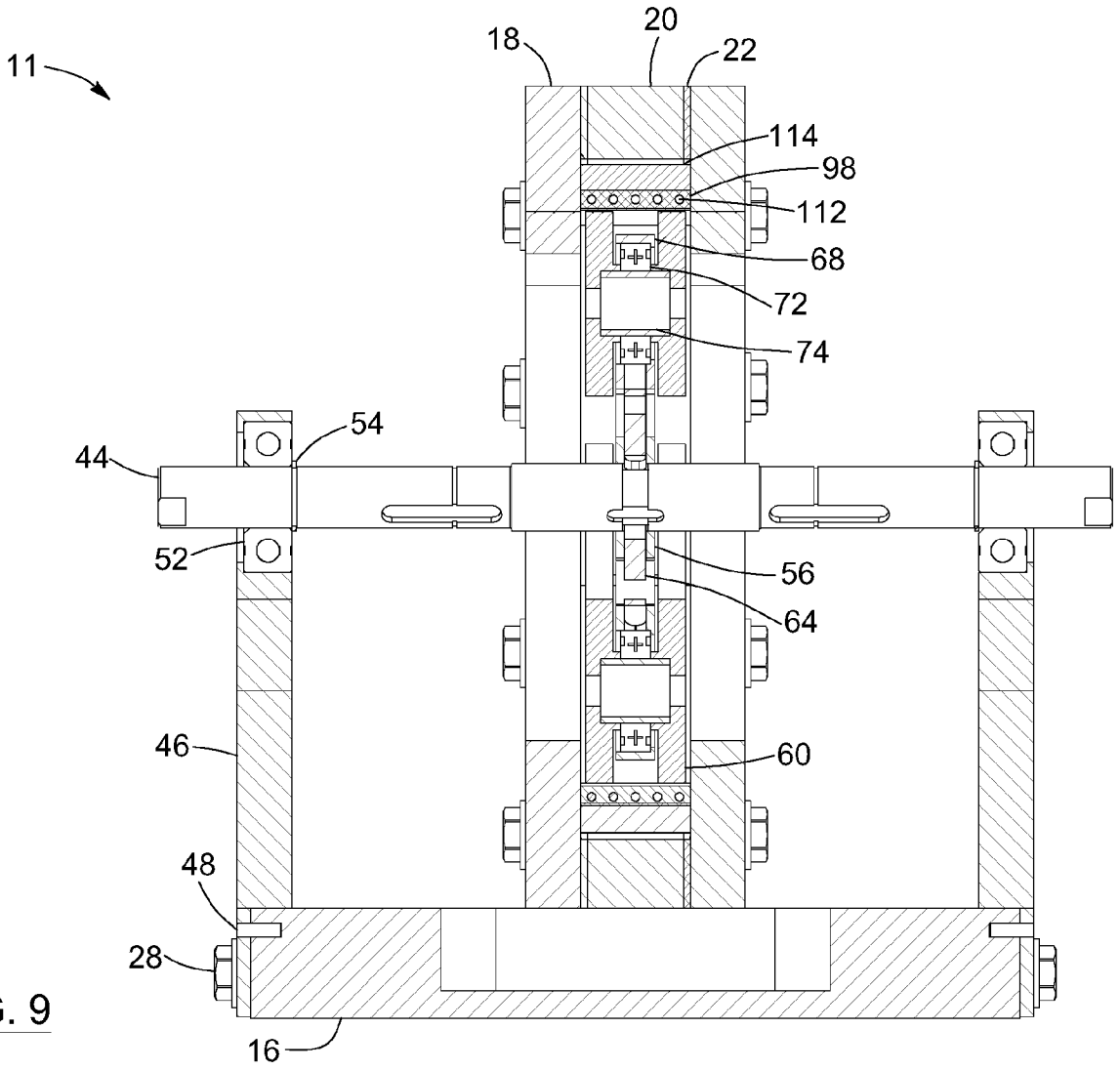
FIG. 9 is a sectional view of the rotary apparatus shown in FIG. 8.

Turning now to FIGS. 8 and 9, there is shown an alternative embodiment of a rotary apparatus 11 and, more particularly, a pump 11. The rotary apparatus 11 is similar to the rotary apparatuses 10, 10*a* described above in reference to FIGS. 1 to 7, except regarding the rotor mechanism 34. For concision purposes, only the differences between the two embodiments will be discussed hereinbelow.

The rotary apparatus 11 includes a rhomboidal rotor mechanism 94 comprising the rotor assembly 36 and a belt 96 mounted to a periphery of the rotor assembly 36. The rotor assembly 36 is similar to the rotor assembly 36 described above in reference to FIGS. 1 to 6 and will not be further described hereinbelow for concision.

Figure 11:
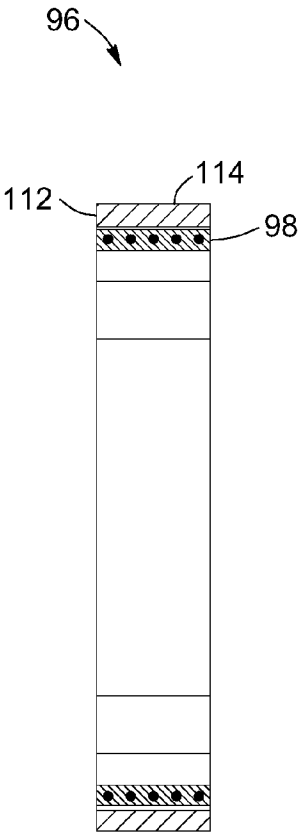
FIG. 11 is a sectional view of the assembled belt shown in FIG. 10.
Figure 10:
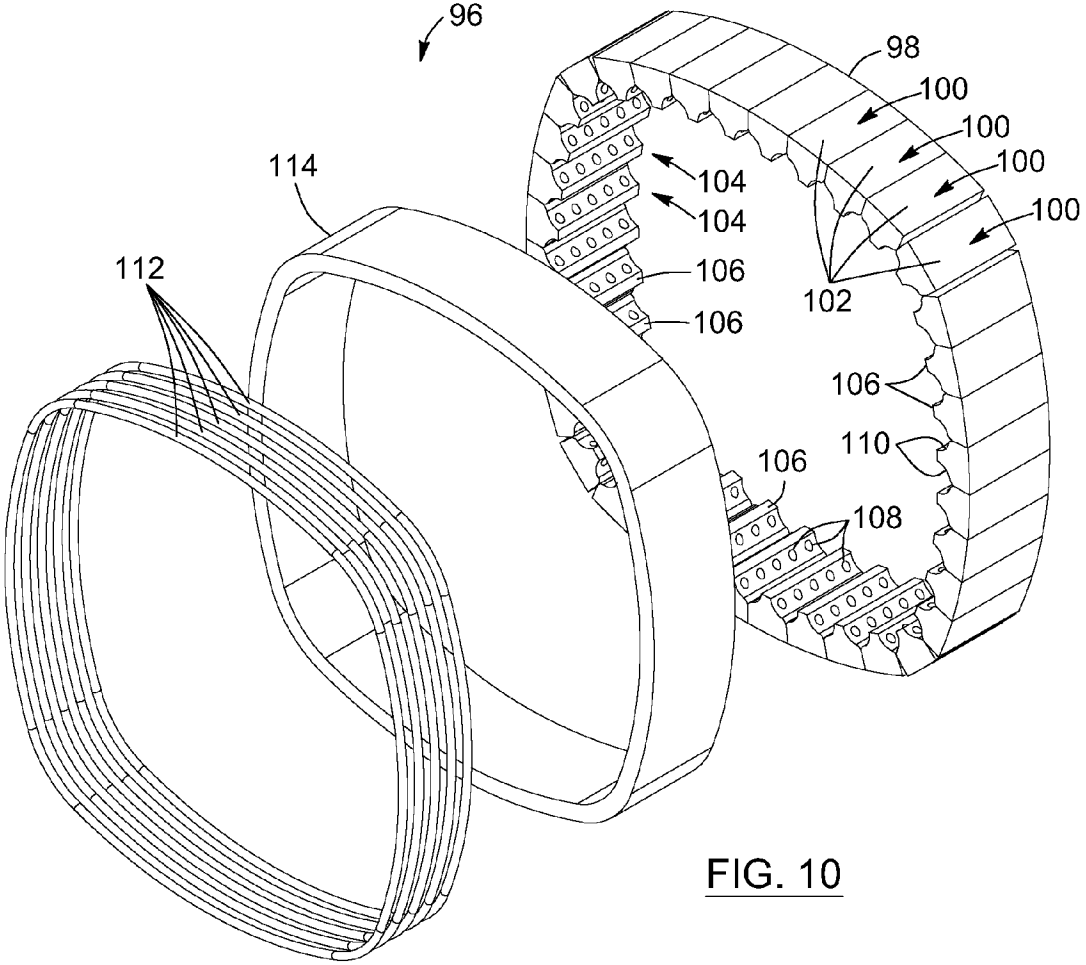
FIG. 10 is an exploded perspective view of the belt of the rotor mechanism shown in FIG. 8.

Turning to FIGS. 10 and 11, the belt 96 comprises a track belt 98 having a plurality of rigid track members 100 partially and pivotally connected to one another in a side by side adjacent fashion to define a closed-loop. The outer surface 102 of each track member 100 is relatively smooth and curved while the inner surface 104 of each track member 100 defines an inward V-shaped protrusion 106. The V-shaped protrusion 106 is perforated. More particularly, openings 108 are defined in each sloped side 110 thereof. Steel cable rings 112 are mounted through the holes 108. An outer strap 114 is mounted peripherally on the track belt 98, i.e. it is superposed to the outer surface 102 of the track belt 98, and engages sections of the inner contour wall 32 of the chamber 30. The track belt 98 is substantially rigid to support the flexible support strap 114, which defines a closed-loop.

Once again, the rotor assembly 36 is a rigid structure with a variable shape (depending on its configuration within the internal fluid chamber 30), which supports and defines the shape of the flexible closed-loop belt 96 mounted peripherally thereof. The belt 96 is flexible in a manner such that it conforms to the shape of the rotor assembly 36. The belt 96 is configured to abut sections of the inner contour wall 32 of the chamber 30, i.e. the contact points. The contact points vary in accordance with the shape of the rotor assembly 36 to which the belt 96 is mounted.

In operation, the shaft 44 is actuated to rotate about its longitudinal axis thereby causing the rotor assembly 36 to rotate therewith. Consequently, the rollers 60 rollingly engage the inner surfaces 104 of the track members 100 defining the track belt 98 and the peripheral shape of the outer strap 114 deforms simultaneously, conforming to the shape of the rotor assembly 36. As the belt 38, the rotation of the belt 98 during rotation of the rotor assembly 36 is limited and caused by the friction between the rollers 60 and the inner surface of the track belt 98.

The compression cycle of the apparatus 11 is similar to the one of the apparatus 10 described above in reference to FIGS. 7*a*, 7*b*, and 7*c* and will not be described in detail.

Figure 12:
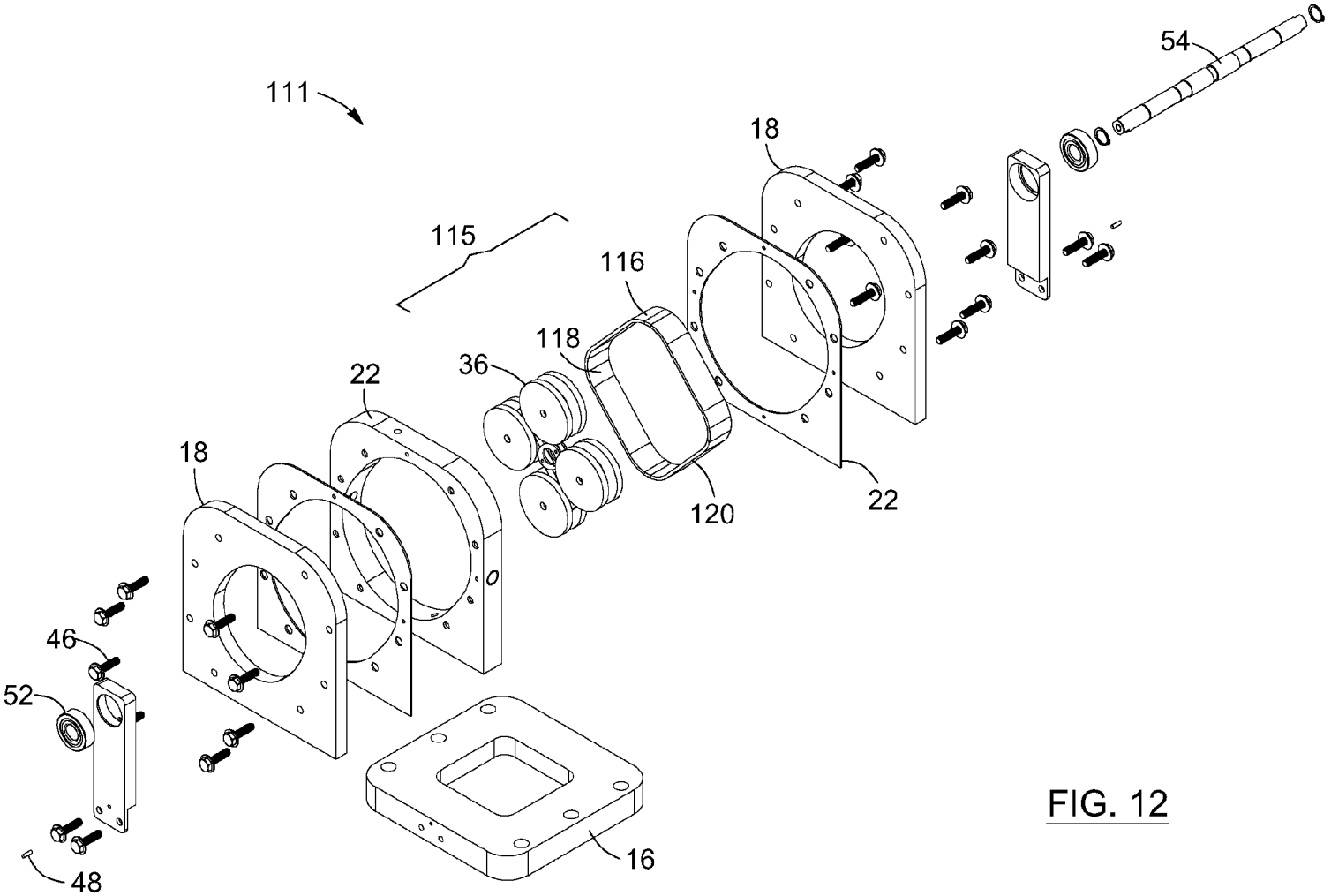
FIG. 12 is an exploded perspective view of a rotary apparatus in accordance with another embodiment, with still another embodiment of a rotor mechanism.
Figure 13:
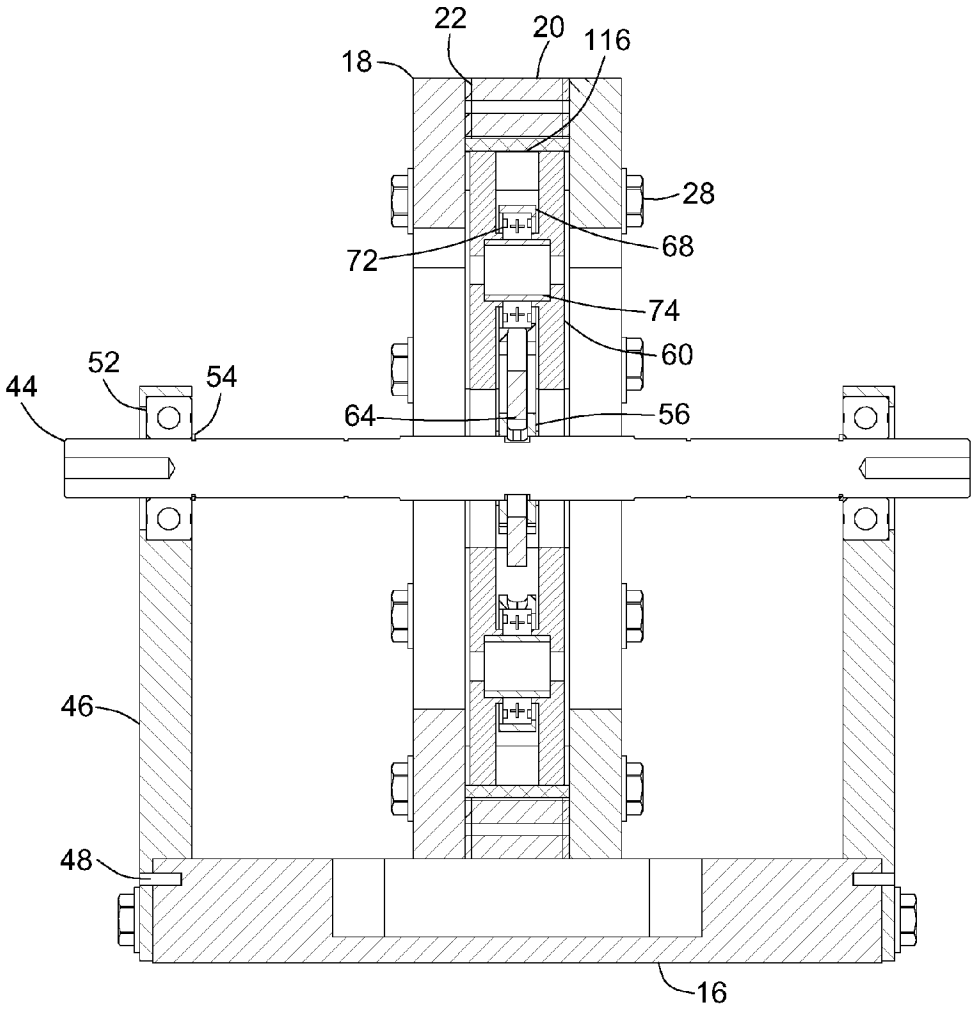
FIG. 13 is a sectional view of the rotary apparatus shown in FIG. 12.

Turning now to FIGS. 12 and 13, there is shown another embodiment of a rotary apparatus 111. The rotary apparatus 111 is similar to the rotary apparatus 10, 10*a*, and 11 described above in reference to FIGS. 1 to 11, except regarding the rotor mechanism 115 and, more particularly, its closed-loop belt 116. For concision purposes, only the differences between the embodiments will be discussed hereinbelow.

The rotary apparatus 111 and, more particularly, a pump, comprises a rhomboidal rotor mechanism 115 including the rotor assembly 36 and the belt 116 mounted to the periphery of the rotor assembly 36. The belt 116 is a closed-loop and flat belt structure having an inner surface 118 and an outer surface 120. In operation, the rollers 60 rollingly engage the inner surface 118 to conform the peripheral shape of the belt 116 to the shape of the rotor assembly 36. The contact points between the belt 116 and the inner contour wall 32 of the chamber 30 slides simultaneously along the inner contour wall 32.

Once again, the rotor assembly 36 is a rigid structure with a variable shape (depending on its configuration within the internal fluid chamber 30), which supports and defines the shape of the flexible closed-loop belt 116 mounted peripherally thereof. The belt 116 is flexible in a manner such that it conforms to the shape of the rotor assembly 36. The belt 116 is configured to abut sections of the inner contour wall 32 of the chamber 30, i.e. the contact points. The positions of the contact points vary in accordance with the shape of the rotor assembly 36 to which the belt 116 is engaged. Once again, the belt 116 is not engaged in rotation by the rotor assembly 36. Rotation of the belt 116 may occur due to the friction between the rollers 60 and the inner surface 118 of the belt 116.

In operation, the shaft 44 is actuated to rotate about its longitudinal axis thereby causing the rotor assembly 36 to rotate therewith. Consequently, the rollers 60 rollingly engage the inner surfaces 118 of the belt 116 and the outer strap 114 simultaneously changes its peripheral shape to conform to shape of the rotor assembly 36.

The compression cycle of the apparatus 111 is similar to the one of the apparatus 10 described above in reference to FIGS. 7*a*, 7*b*, and 7*c* and will not be described in detail.

Figure 14:
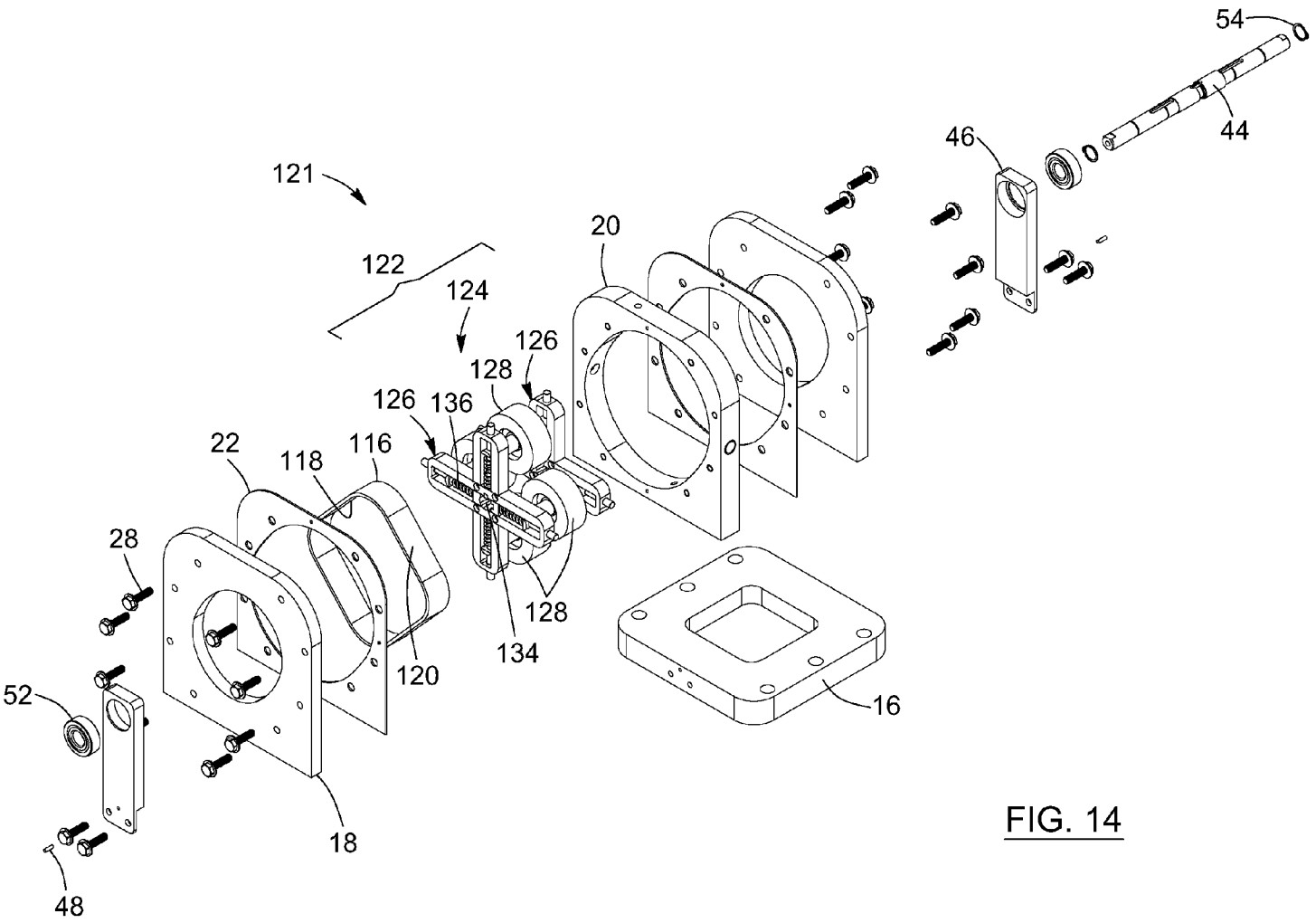
FIG. 14 is an exploded perspective view of a rotary apparatus in accordance with another embodiment, with a further embodiment of a rotor mechanism.
Figure 15:
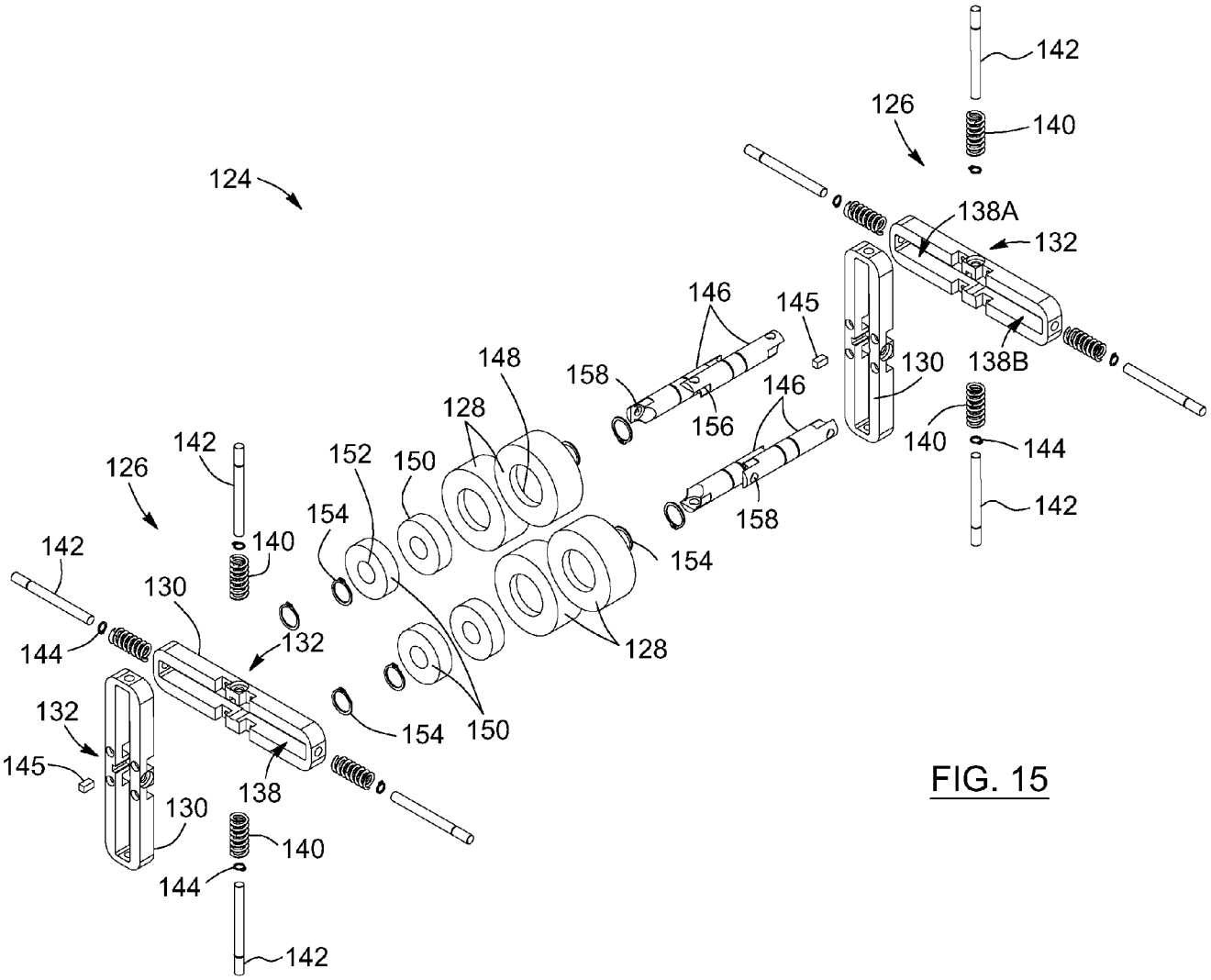
FIG. 15 is an exploded perspective view of a rotor assembly of the rotor mechanism shown in FIG. 14.
Figure 16:
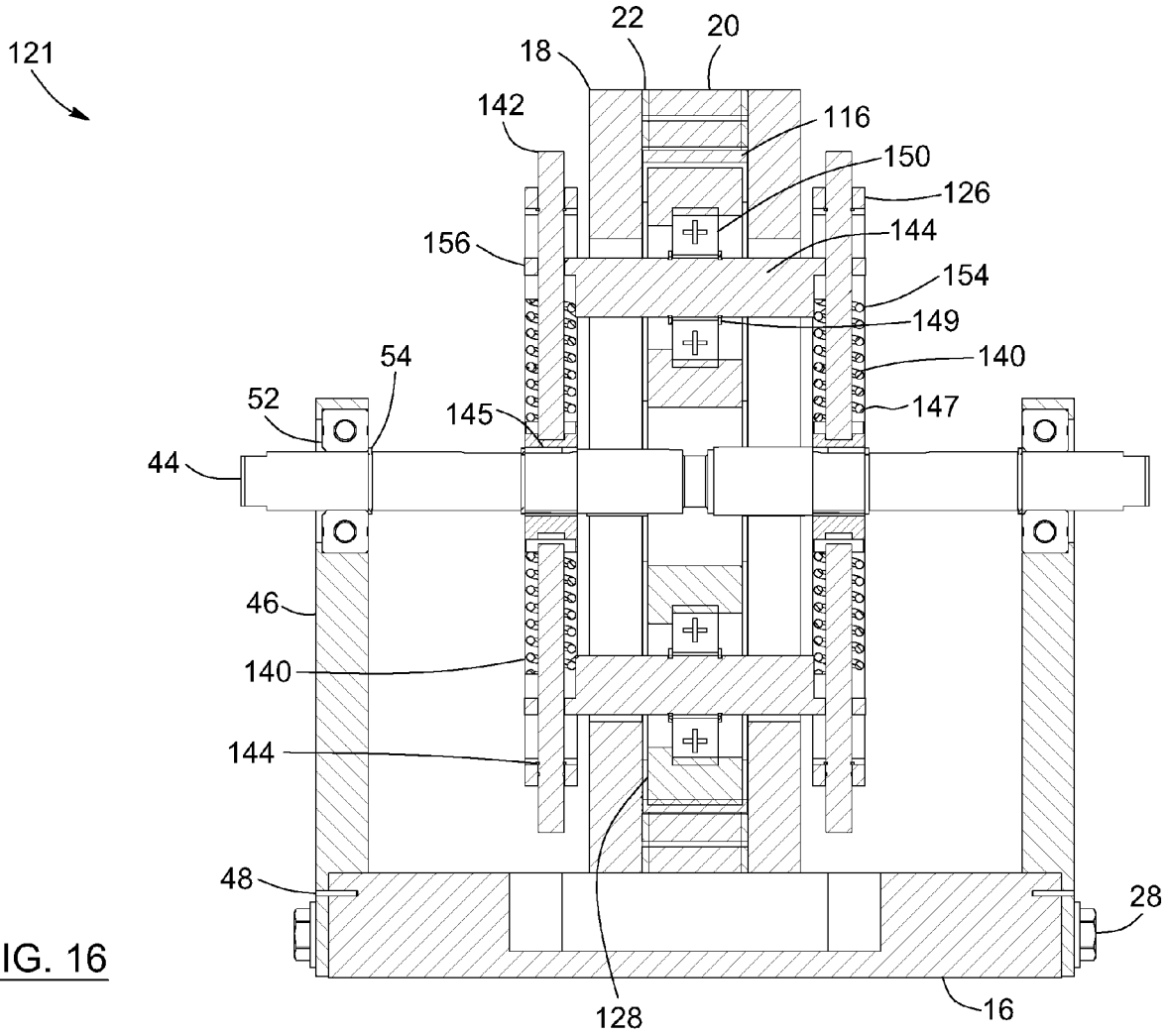
FIG. 16 is a sectional view of the assembled rotary apparatus shown in FIG. 14.
Figure 17:
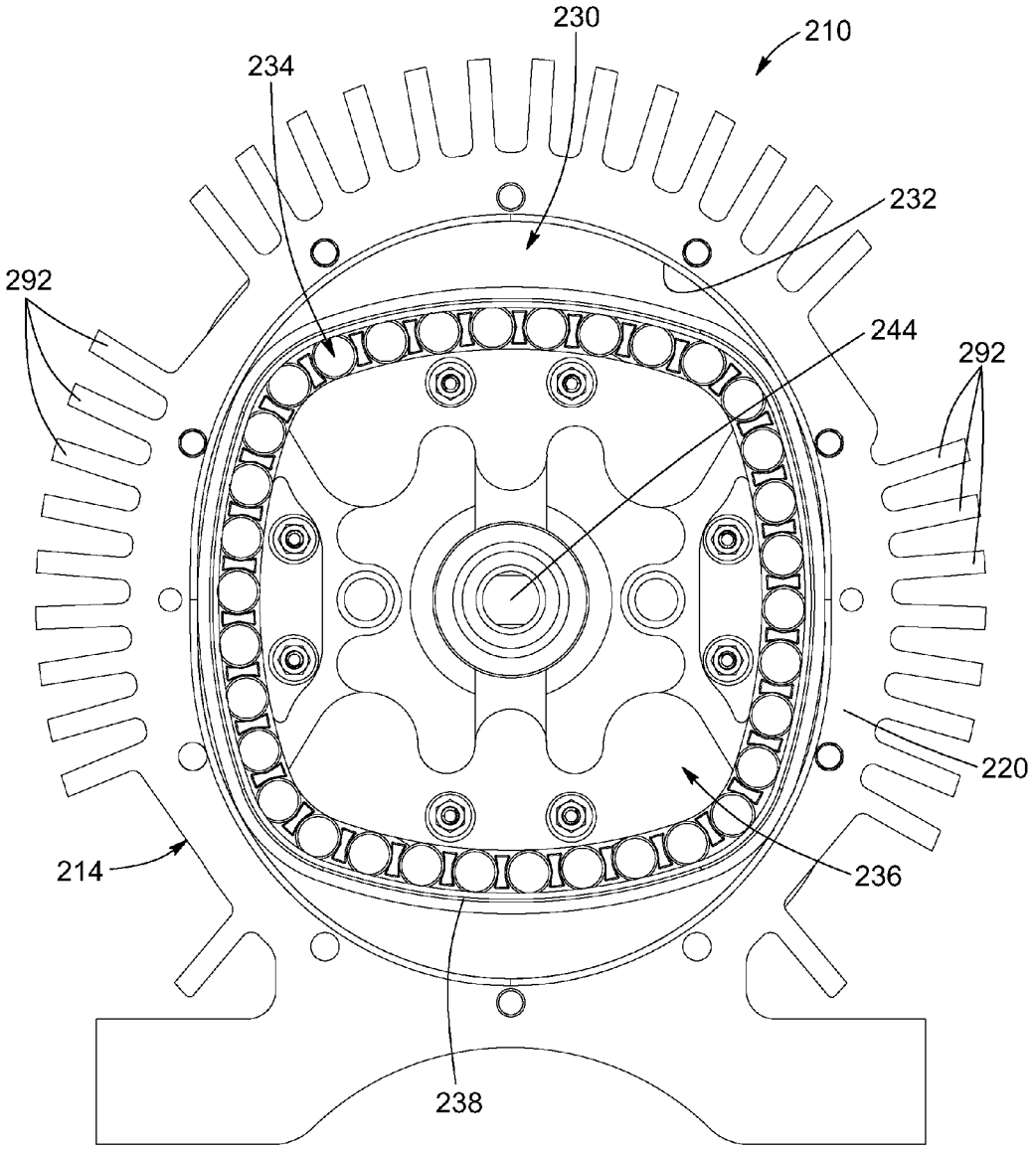
FIG. 17 is a front elevation view of a rotary apparatus in accordance with another embodiment, with still another embodiment of a rotor mechanism including an annular flexible bearing and wherein lateral plates are removed.

Turning now to FIGS. 14 to 16, there is shown another embodiment of a rotary apparatus 121. The rotary apparatus 121 is similar to the rotary apparatus 10, 10*a*, 11, and 111, except for the rotor mechanism 122 including its rotor assembly 124 and its belt 116. For concision purposes, only the differences between the embodiments will be discussed hereinbelow.

The rotary apparatus 121 and, more particularly, a pump, comprises a rhomboidal rotor mechanism 122 including a rotor assembly 124 and the belt 116 mounted at a periphery of the rotor assembly 124.

Referring to FIGS. 14 and 15, there is shown that the rotor assembly 124 includes a pair of spring loaded cross supports 126 rotatably sandwiching four rollers 128 therebetween. Each cross support 126 includes a pair of interconnected longitudinal members 130 that are fitted in a perpendicular relationship at their indented middle portions 132. The indented middle portions 132 are complementarily configured so as to form a rectangular center-portion 134 defining a central rectangular aperture 136 for receiving the shaft 44 therethrough. Each longitudinal member 130 further comprises an elongated slot 138 defined therein. When the longitudinal members 130 are engaged together, they form the cross support 126 and the elongated slots 138 are divided into two slot portions 138A and 138B along each member 130 of the support 126 and, more specifically, each one of the slot portions 138A and 138B extends between the center-portion 134 and an end of each longitudinal member 130. Each one of the slot portions 138A and 138B receives a spring member 140 therein. The spring members 140 are mounted to a support rod 142 via a retaining ring 144.

Therefore, when assembled, each cross support 126 provides for four slot portions 138A or 138B. Each one of the slot portions 138A or 138B retains therein a respective spring member 140. The assembled cross support 126 provides an aperture 136 for receiving the shaft 44 therein. Each spring member 140 is secured to the center-portion 134 via a cleat 145 at one fixed end 147 (see FIG. 16) thereof with its opposite end 149 being movable along the length of its respective support rod 142.

The rotor assembly 124 further includes four roller shafts 146, each one carrying a respective roller 128. Each roller 128 comprises a central aperture 148 for receiving a bearing 150. Each bearing 150 includes an aperture 152 for receiving a respective one of the roller shafts 146. The roller shafts are connected to a respective one of the bearings 150 via a pair of retaining rings 154. As such, the rollers 128 can roll about the longitudinal axis of their respective roller shaft 146.

Each shaft 146 is mounted at each longitudinal end thereof to one of the members 140. More specifically, each longitudinal end of the roller shaft 146 defines a shoulder structure 156 for being connected to the movable end 149 of their respective spring member 140. Each shoulder structure 156 comprises an aperture 158 defined therein for receiving the connecting rod 142 therethrough.

In this way, the roller shafts 146 can oscillate along the length of the slot portions 138A or 138B thereby oscillating the rollers 128 simultaneously therewith.

The belt 116 is mounted about the rollers 128 and conforms to the shape of the rotor assembly 36. The contact points between the belt 116 and the inner contour wall 32 slide along the contour wall 32 upon rotation of the rollers 128. Rotation of the belt 116 during rotation of the rotor assembly 124 is limited and caused by the friction between the rotor assembly 124 and the inner surface of the belt 116. The displacement of the contact points along the inner contour wall 32 is due to the changes of the shape of the belt 116.

FIG. 16 shows a sectional view of the rotary apparatus 121 when assembled.

In operation, the shaft 44 imparts a rotational movement to the rotor assembly 124 and the rollers 128 rollingly engage the inner surface 118 of the belt 116 causing the belt 116 to conform to the shape of the rotor assembly 124 and displace its contact points with the inner contour 32 of the chamber 30.

Once again, the rotor assembly 124 is a rigid structure with a variable shape (depending on its configuration within the internal fluid chamber 30), which supports and defines the shape of the flexible closed-loop belt 116 mounted peripherally thereof. The belt 116 is flexible in a manner such that it conforms to the shape of the rotor assembly 124. The belt 116 is configured to abut sections of the inner contour wall 32 of the chamber 30, i.e. the contact points. The contact points between the belt 116 and the inner contour wall 32 vary in accordance with the shape of the rotor assembly 124 to which the belt 116 is engaged.

In operation, the shaft 44 is actuated to rotate about its longitudinal axis thereby causing the rotor assembly 124 to rotate therewith. Consequently, the rollers 128 rollingly engage the inner surfaces 118 of the belt 116 and the peripheral shape of the belt 116 varies simultaneously. The contact point positions along the inner contour wall 32 are also modified during rotation.

The compression cycle of the apparatus 121 is similar to the one of the apparatus 10 described above in reference to FIGS. 7*a*, 7*b*, and 7*c* and will not be described in detail.

Turning now to FIGS. 17 to 21, there is shown another embodiment of a rotary apparatus 210. The rotary apparatus 210 is similar to the rotary apparatus 10, 10*a*, 11, 111, and 121, except for the rotor mechanism 234 including its rotor assembly 236 and its belt 238. For concision purposes, only the differences between the embodiments will be discussed hereinbelow.

Figure 18:
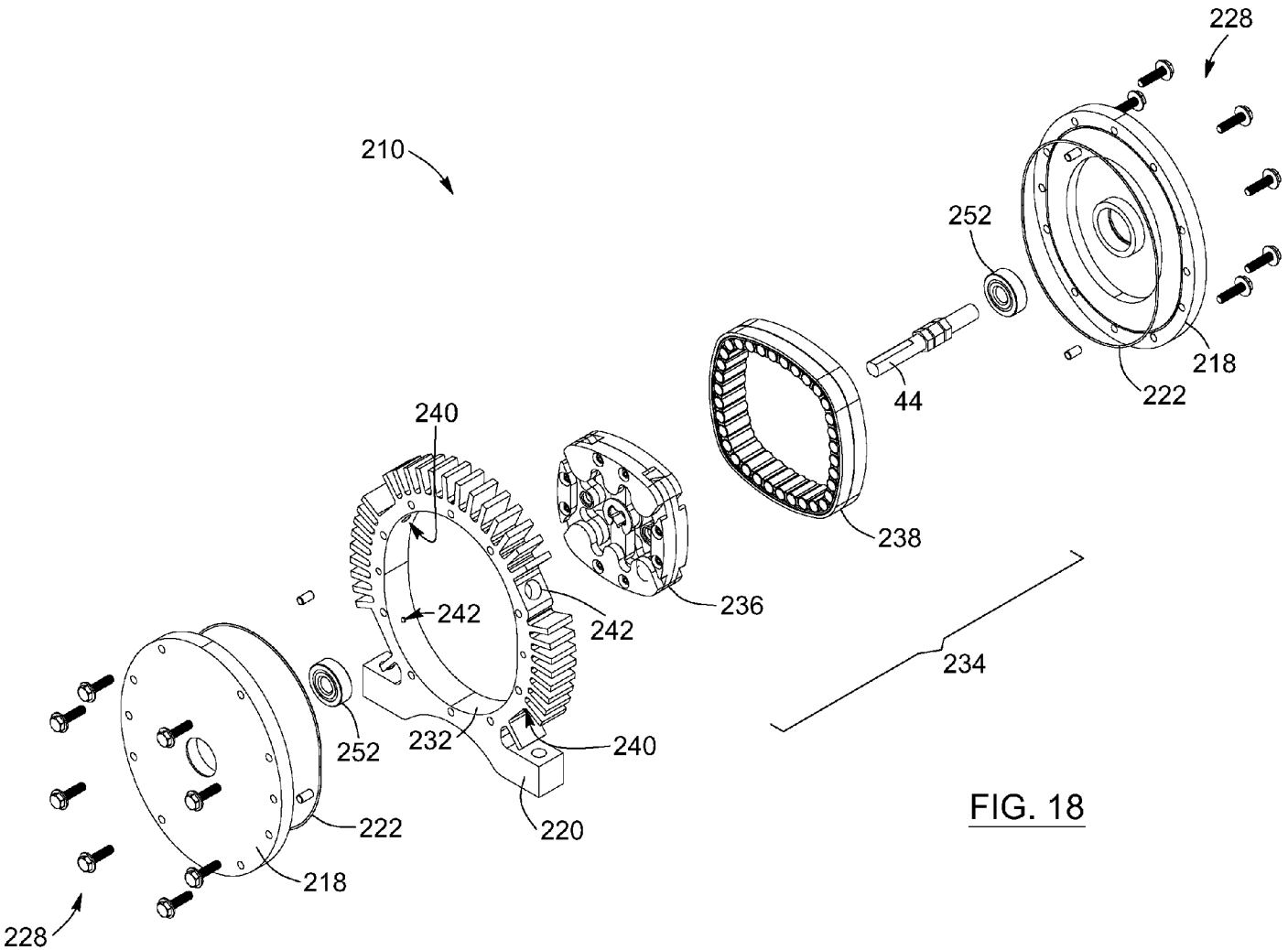
FIG. 18 is an exploded perspective view of the rotary apparatus shown in FIG. 17 and including the lateral plates.

The rotor apparatus 210, such as a pump, comprises a profile plate 220 sandwiched between two lateral plates 218 (see FIG. 18). Leak proof seals 222 are positioned between each side of the profile plate 220 and each lateral plate 218. The foregoing pieces are assembled together via fasteners 228 to provide a stator housing 214.

The assembled housing 214 defines an ovaloidal fluid chamber 230 circumscribed by an inner contour wall 232 for housing a substantially rhomboidal rotor mechanism 234 including, amongst others, a rotor assembly 236 and a belt 238. The belt 238 defines a closed-loop and is mounted to the periphery of the rotor assembly 236. Two radial intake ports 240 and two radial outtake ports 242 extend through the profile plate 220, in an alternating configuration. The intake and outtake ports 240, 242 are in fluid communication with the fluid chamber 230 and respectively provide for intake of fluid in the fluid chamber 30 and exhaust of fluid therefrom. The profile plate 220 has a plurality of fins 292 protruding from an outer surface thereof to promote heat exchange between the housing and ambient air. It is appreciated that the shape of the housing and the number and the shape of the fins can vary from the embodiments shown in the accompanying figures.

Figure 21:
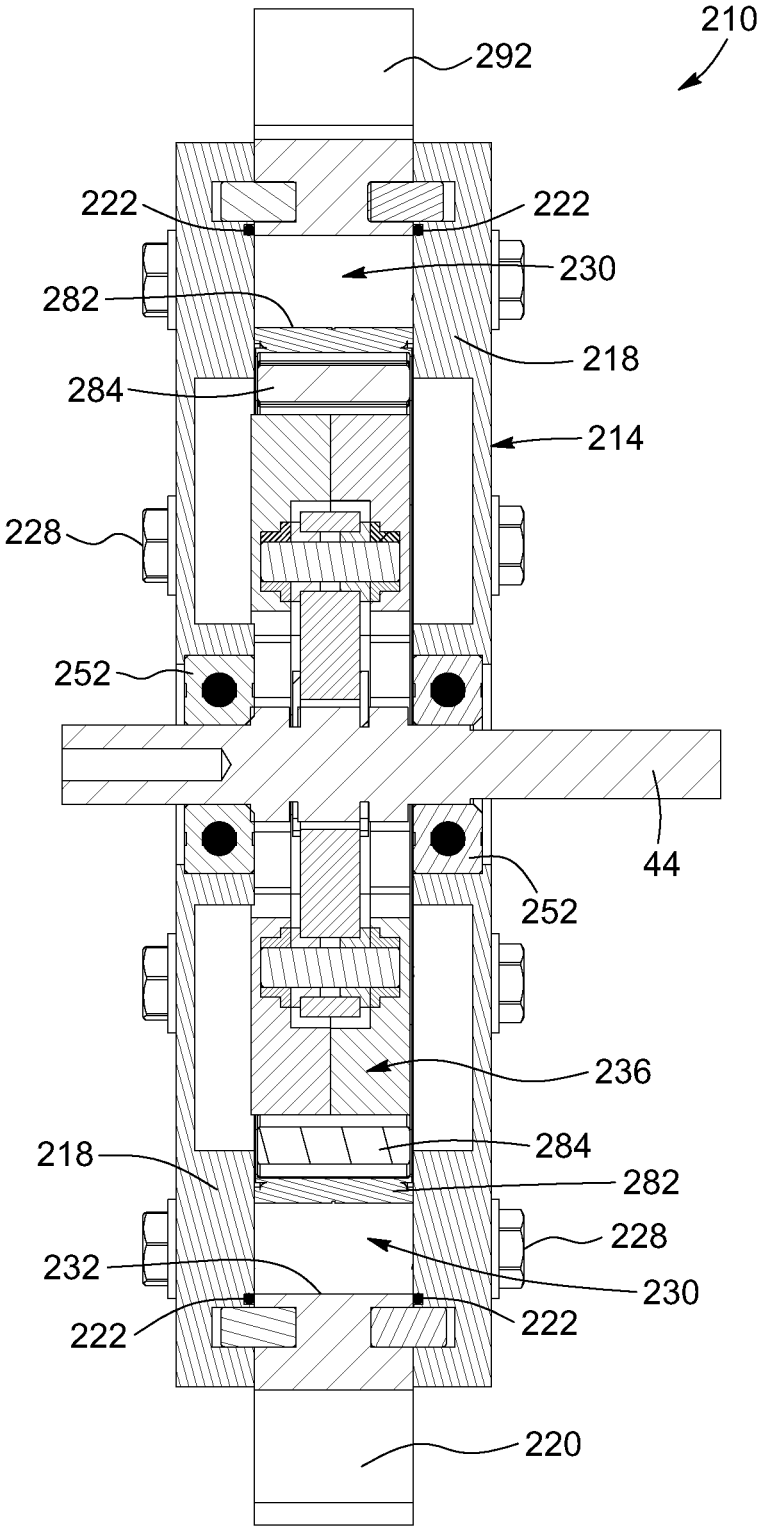
FIG. 21 is a sectional view of the assembled rotary apparatus shown in FIG. 17.

A shaft 44 traverses the stator housing 214 through the fluid chamber 230 and is operatively connected to the rotor assembly 236. Rotation of the shaft 44 engages the rotor assembly 236 in rotation. The shaft 44 can be supported by any suitable structure and is part of a movement imparting assembly, as it is known in the art. The combination of the leak proof seals 222, the lateral plates 218, the inner wall 232, and the rotor mechanism 234 prevents fluid communication between the fluid chamber 230 and the atmosphere. FIG. 21 shows a sectional view of the rotary apparatus 210 when assembled.

Figure 19:
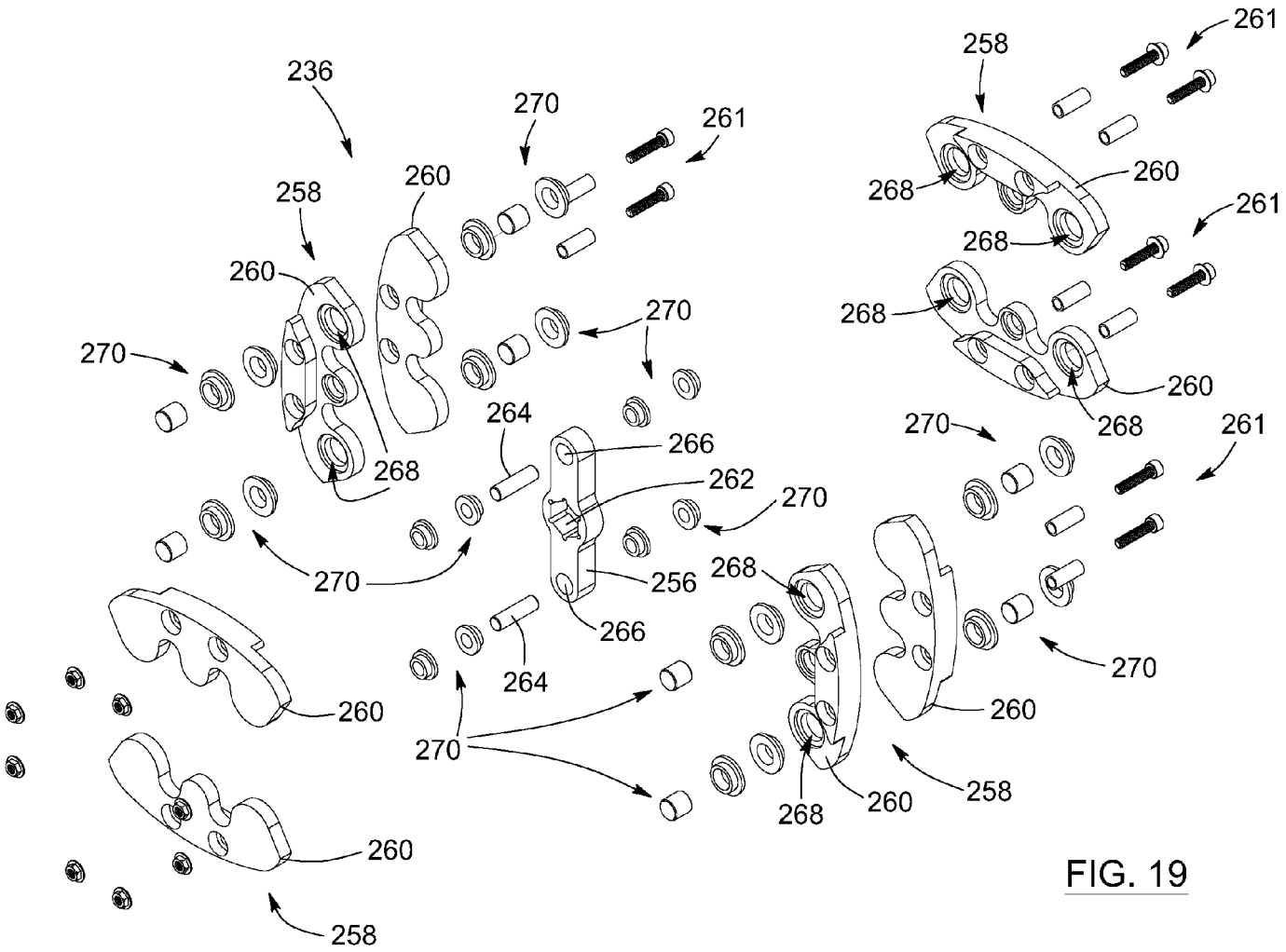
FIG. 19 is an exploded perspective view of a rotor assembly of the rotary apparatus shown in FIG. 17.

Turning now to FIGS. 18 and 19, there is shown that the rotor assembly 236 comprises a centerpiece 256 and four blades 258. Each one of the blades 258 includes two blade members 260 secured together with fasteners 261. The centerpiece 256 comprises a central aperture 262 for receiving the shaft 44 therethrough and being engaged therewith. Rotation of the shaft 44 drives the centerpiece 256 in rotation. The centerpiece 256 is pivotally connected to two of the blades 258, spaced-apart from one another, via a pair of connecting rods 264. Accordingly, the centerpiece 256 comprises two spaced-apart through holes 266 for receiving and pivotally engaging the connecting rods 264 therein. Bearing or bushing assemblies can be provided to pivotally connect the centerpiece 256 to the two spaced-apart blades 258.

Each blade 258 has two opposite longitudinal ends pivotally connected to an end of an adjacent one of the blades 258. The ends of the blades 258 include a circular cavity 268 defined therein. The circular cavities 268 of two adjacent blades 258 are in register with one another and the blades are pivotally engaged together with bushing or bearing assemblies 270 insertable in the circular cavities. When assembled, each blade 258 is pivotally connected to two adjacent blades 258 and the rotor assembly 236 is rotatable about a rotation axis which corresponds to the central aperture 262 through which the shaft 44 is engageable.

Figure 20:
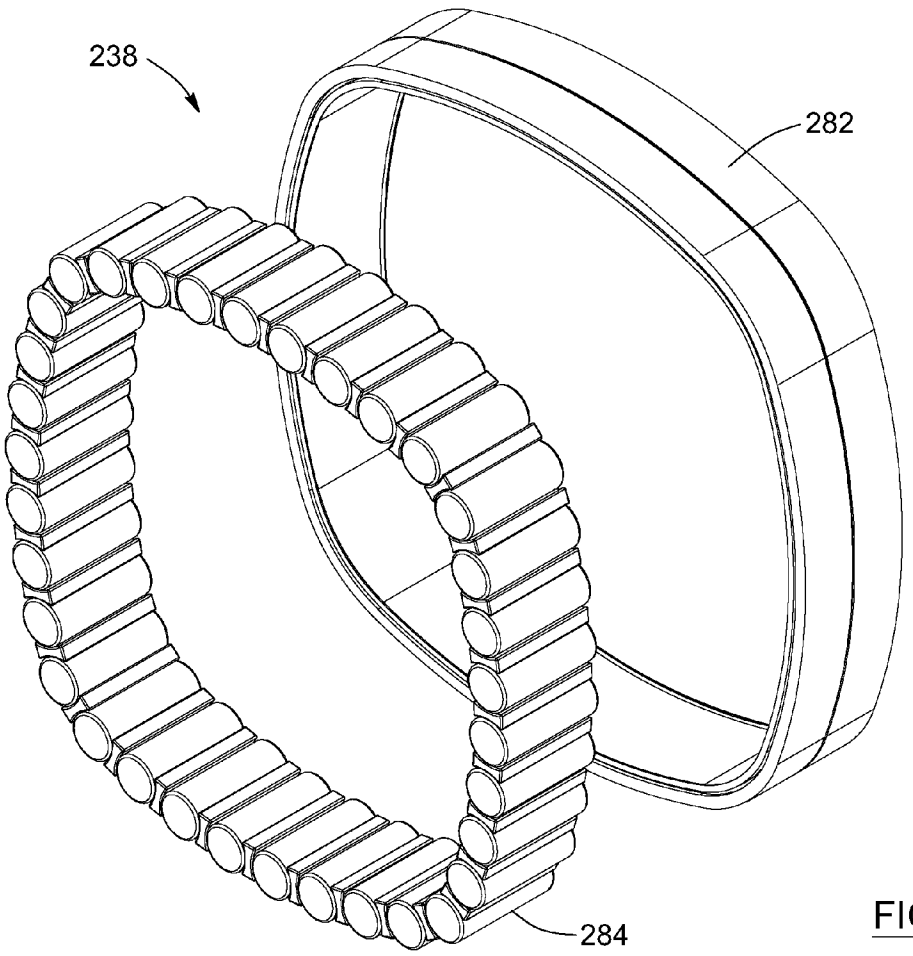
FIG. 20 is an exploded perspective view of a belt of the rotary apparatus shown in FIG. 17.

FIG. 20 shows that the belt 238 comprises an outer strap 282 strapped onto an annular bearing assembly 284. The outer strap 282 and the annular bearing assembly 284 are closed-loop components. In an embodiment, the outer strap 282 is a continuous polymeric strap. The annular bearing assembly 284 is mounted to the periphery of the rotor assembly 236.

Rotation of the shaft 44 modifies the peripheral shape of the rotor assembly 236. Consequently, the peripheral shape of the belt 238, including the annular bearing assembly 284 and the outer strap 282, is simultaneously modified. Thus, the contact points between the outer strap 282 and the inner contour wall 232 of the chamber 230 vary simultaneously with the rotation of the shaft 44.

In operation, the shaft 44 is actuated and rotates about its longitudinal axis thereby causing the rotor assembly 236 to rotate therewith since its centerpiece 256 is connected to the shaft 44. Rotation of the rotor assembly 236 simultaneously modifies its outer peripheral shape and engages the inner surface of the annular bearing assembly 284. The rotor assembly 236 slides on the inner surface of the annular bearing assembly 284 and simultaneously deforms the outer peripheral shape thereof. The peripheral shape of the outer strap 282 including its contact points with the inner contour wall 232 is consequently modified.

The rotor assembly 236 is a rigid structure with a variable shape (depending on its configuration) within the internal fluid chamber 230, which supports and defines the shape of the flexible closed-loop belt 238 mounted peripherally thereof. The belt 238 is flexible in a manner such that it conforms to the shape of the rotor assembly 236. The belt 238 is configured to abut sections of the inner contour wall 232 of the chamber 230. The sections abutted by the belt 328, i.e. the contact points, vary in accordance with the shape of the rotor assembly 236 to which the belt 238 is peripherally mounted.

The rotor mechanism 234 thus rotates in the fluid chamber 230. During rotation, the volume of the rotor mechanism 234 varies. Consequently, the free volume of the fluid chamber 230, i.e. the volume of the chamber 230 unoccupied by the rotor mechanism 234, varies simultaneously. Furthermore, during rotation, the configuration of the rotor mechanism 234 within the fluid chamber 230 varies.

During rotation, the contact points of the belt 238 slides along the inner contour wall 232. It is possible that the belt 238 also slides slightly with respect to the contour wall 232. In one non-restrictive example, the strap 282 can be made of a smooth, resilient and deformable polymeric material.

The compression cycle of the apparatus 210 is similar to the one of the apparatus 10 described above in reference to FIGS. 7*a*, 7*b*, and 7*c* and will not be described in detail.

One skilled in the art will appreciate that combinations of the above-described embodiments can be foreseen.

The rotor mechanisms described above includes a rotatable rotor assembly having an articulated rigid structure which peripheral outer shape is modified during rotation thereof. A belt is mounted to the periphery of the rotatable rotor assembly. The belt includes a strap having a continuous outer surface. It can also include an articulated closed-loop rigid structure underlying the strap, such as the flexible annular bearing assembly 284, the chain assembly 84, and the track belt 98, for instance.

The housing includes at least one fluid intake port and at least one fluid outtake port. In the embodiments described above, the housing includes two fluid intake ports ant two fluid outtake ports but the housing can include more or less fluid ports. The belt engages sections of the inner wall of the fluid chamber at four contact points. For one complete rotation of the rotor assembly) (360°), the belt seals the fluid intake ports ant two fluid outtake ports in four configurations of the rotor assembly, i.e. the fluid intake ports ant two fluid outtake ports are sealed four times by the belt for a complete rotation of the rotor assembly. The number of contact points can vary from the described embodiments.

Moreover, although the embodiments of the rotor assembly and corresponding parts thereof consist of certain geometrical configurations as explained and illustrated herein, not all of these components and geometries are essential to the invention and thus should not be taken in their restrictive sense. It is to be understood, as also apparent to a person skilled in the art, that other suitable components and cooperations thereinbetween, as well as other suitable geometrical configurations, may be used for the rotor assembly according to the present invention, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

Several alternative embodiments and examples have been described and illustrated herein. The embodiments of the invention described above are intended to be exemplary only. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention. The scope of the invention is therefore intended to be limited solely by the scope of the appended claims.

What is claimed is:

1. A pump comprising:

a housing having an inner contour wall defining a fluid chamber;

a rotor mechanism positioned within the fluid chamber and comprising a rotatable rotor assembly with a plurality of elongated blades, each one of the plurality of elongated blades having opposite longitudinal ends and being pivotally connected to at least another one of the plurality of elongated blades at a pivot axis located at or between the opposite longitudinal ends, and a belt mounted to the rotor assembly for engaging the inner contour wall;

a movement imparting assembly comprising a rotatable shaft operatively connected to the rotor assembly for imparting a rotational movement thereto; and intake and outtake ports defined in the housing in communication with the fluid chamber providing for intake of fluid therein and exhaust of fluid therefrom, the intake and outtake ports being sealed by the belt in at least one configuration of the rotor assembly, wherein the rotor assembly has a peripheral outer shape which varies during rotation thereof and the belt has a peripheral closed-loop shape which conforms to the peripheral outer shape of the rotor assembly.

2. The pump as claimed in claim 1, wherein a peripheral closed-loop shape of the belt changes during rotation of the rotor assembly.

3. The pump as claimed in claim 1, wherein the belt comprises a polymeric closed-loop strap with a continuous outer surface.

4. The pump as claimed in claim 1, wherein the belt comprises a closed-loop strap and an articulated closed-loop structure underlying the closed-loop strap.

5. The pump as claimed in claim 4, wherein the articulated closed-loop structure comprises a flexible annular bearing assembly mounted to a periphery of the rotor assembly and having an outer surface juxtaposed inwardly to an inner surface of the closed-loop strap.

6. The pump as claimed in claim 1, wherein the rotor assembly comprises an articulated rigid structure underlying the belt and a peripheral outer shape of the articulated rigid structure is modified during rotation of the rotor assembly.

7. The pump as claimed in claim 1, wherein the fluid chamber is ovaloidal shaped and the rotor assembly is rhomboidal shaped.

8. The pump as claimed in claim 1, wherein the intake ports and the outtake ports are configured in an alternating configuration and the intake and outtake ports are sealed simultaneously by the belt.

9. The pump as claimed in claim 1, wherein the intake and outtake ports are sealed by the belt in at least four configurations of the rotor assembly per rotation thereof.

10. The pump as claimed in claim 1, wherein the belt abuts the inner contour wall at at least four contact points and positions of the contact points on the inner contour wall rotate simultaneously with the rotor assembly and wherein a respective one of the intake and the outtake ports is sealed when a corresponding one of the contact points is aligned therewith.

11. The pump as claimed in claim 1, wherein the rotor assembly comprises a plurality of rollers mounted inwardly of the belt and the rollers are operatively connected to the movement imparting assembly.

12. A rotary apparatus comprising:

a housing having an inner wall defining a fluid chamber and having at least one intake port and at least one outtake port in fluid communication with the fluid chamber respectively providing for intake of fluid therein and exhaust of fluid therefrom; and a rotor mechanism mounted within the fluid chamber and comprising a rotatable rotor assembly and a belt mounted peripherally to the rotor assembly, the belt includes a closed-loop strap and an articulated closed-loop rigid structure underlying the closed-loop strap and having an outer surface juxtaposed inwardly to an inner surface of the closed-loop strap, wherein the belt engages sections of the inner wall during rotation of the rotor assembly.

13. The rotary apparatus as claimed in claim 12, wherein the closed-loop strap of the belt has a continuous outer surface.

14. The rotary apparatus as claimed in claim 13, wherein the articulated closed-loop rigid structure comprises a flexible annular bearing assembly mounted to a periphery of the rotor assembly.

15. The rotary apparatus as claimed in claim 12, wherein the rotor assembly has a peripheral outer shape which varies during rotation thereof and the closed-loop strap has a peripheral closed-loop shape which conforms to the peripheral outer shape of the rotor assembly, a peripheral shape of the belt changing during rotation of the rotor assembly.

16. The rotary apparatus as claimed in claim 12, further comprising a movement imparting assembly comprising a rotatable shaft and wherein the rotor assembly comprises a plurality of rollers mounted inwardly of the belt and operatively connected to the rotatable shaft of the movement imparting assembly to impart for a rotational movement to the rotor assembly.

17. The rotary apparatus as claimed in claim 12, wherein the fluid chamber is ovaloidal shaped and the rotor assembly is rhomboidal shaped.

18. The rotary apparatus as claimed in claim 12, comprising two intake ports and two outtake ports defined in the housing and in fluid communication with the fluid chamber, the intake and outtake ports being sealed by the belt in at least one configuration of the rotor assembly.

19. The rotary apparatus as claimed in claim 12, comprising a plurality of fluid intake ports and a plurality of fluid outtake ports and the fluid intake ports and the fluid outtake ports are configured in an alternating configuration.

20. The rotary apparatus as claimed in claim 12, wherein the at least one intake port and the at least one outtake port are sealed simultaneously by the belt.

21. The rotary apparatus as claimed in claim 12, wherein the belt abuts the inner wall at at least four contact points and positions of the contact points on the inner wall rotate simultaneously with the rotor assembly, and wherein a respective one of the at least one intake port and the at least one outtake port is sealed when a corresponding one of the contact points is aligned therewith.

22. A pump comprising:

a housing having an inner contour wall defining a fluid chamber;

a rotor mechanism positioned within the fluid chamber and comprising a rotatable rotor assembly with a plurality of pivotally connected blades and a belt mounted to the rotor assembly for engaging the inner contour wall, the belt comprises a closed-loop strap and an articulated closed-loop structure underlying the closed-loop strap, the articulated closed-loop structure comprising a flexible annular bearing assembly mounted to a periphery of the rotor assembly and having an outer surface juxtaposed inwardly to an inner surface of the closed-loop strap;

a movement imparting assembly comprising a rotatable shaft operatively connected to the rotor assembly for imparting a rotational movement thereto; and intake and outtake ports defined in the housing in communication with the fluid chamber providing for intake of fluid therein and exhaust of fluid therefrom, the intake and outtake ports being sealed by the belt in at least one configuration of the rotor assembly, wherein the rotor assembly has a peripheral outer shape which varies during rotation thereof and the belt has a peripheral closed-loop shape which conforms to the peripheral outer shape of the rotor assembly.

* * * * *